US008282462B2

(12) United States Patent
Fujimoto et al.

(10) Patent No.: US 8,282,462 B2
(45) Date of Patent: Oct. 9, 2012

(54) GAMING MACHINE WITH A COUNT-VALUE TRIGGERED INSURANCE BONUS GAME AND PLAYING METHOD THEREOF

(75) Inventors: Jun Fujimoto, Tokyo (JP); Yukinori Inamura, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 1210 days.

(21) Appl. No.: 11/987,731

(22) Filed: Dec. 4, 2007

(65) Prior Publication Data

US 2008/0254873 A1 Oct. 16, 2008

Related U.S. Application Data

(60) Provisional application No. 60/907,685, filed on Apr. 13, 2007.

(51) Int. Cl.
*A63F 9/24* (2006.01)

(52) U.S. Cl. ..... 463/20; 463/16

(58) Field of Classification Search ..... 463/16, 463/20, 25–27
See application file for complete search history.

(56) References Cited

U.S. PATENT DOCUMENTS

| | | | | |
|---|---|---|---|---|
| 4,283,709 | A | 8/1981 | Lucero et al. | |
| 4,624,459 | A | 11/1986 | Kaufman | |
| 4,669,731 | A * | 6/1987 | Clarke | 463/20 |
| 4,837,728 | A | 6/1989 | Barrie et al. | |
| 4,964,638 | A | 10/1990 | Ishida | |
| 5,178,390 | A * | 1/1993 | Okada | 273/143 R |
| 5,280,909 | A | 1/1994 | Tracy | |
| 5,564,700 | A | 10/1996 | Celona | |
| 5,611,730 | A | 3/1997 | Weiss | |
| 5,639,088 | A | 6/1997 | Schneider et al. | |
| 5,695,402 | A | 12/1997 | Stupak | |
| 5,702,303 | A | 12/1997 | Takemoto et al. | |
| 5,770,533 | A | 6/1998 | Franchi | |
| 5,820,459 | A | 10/1998 | Acres et al. | |
| 5,836,817 | A | 11/1998 | Acres et al. | |
| 5,890,963 | A | 4/1999 | Yen | |

(Continued)

FOREIGN PATENT DOCUMENTS

DE 3242890 5/1984

(Continued)

OTHER PUBLICATIONS

Macau Office Action and Search Report, English translation included, dated Oct. 22, 2009.

*Primary Examiner* — Dmitry Suhol
*Assistant Examiner* — Jason Yen
(74) *Attorney, Agent, or Firm* — Lexyoume IP Meister, PLLC.

(57) ABSTRACT

A gaming machine executes a unit game in which it is determined whether or not an outcome of the unit game is worth awarding a payout. The gaming machine includes a lower LCD for displaying images relating to the unit games, a counter for accumulating a count-value with successive unit games and resetting the count-value when a predefined reset condition is met, and a controller. The controller provides a predefined payout to a player when the outcome of the unit game turns out to be a specific outcome. The controller also receives a wager for an insurance pay. Furthermore, the controller executes transition into a second game when the count-value reaches a predefined value in the unit game with a wager for the insurance pay, and provides the rescue pay according to an outcome of the second game.

14 Claims, 27 Drawing Sheets

U.S. PATENT DOCUMENTS

| | | | | |
|---|---|---|---|---|
| 5,910,048 | A | 6/1999 | Feinberg | |
| 6,001,016 | A | 12/1999 | Walker et al. | |
| 6,003,013 | A | 12/1999 | Boushy et al. | |
| 6,089,980 | A | 7/2000 | Gauselmann | |
| 6,224,482 | B1 | 5/2001 | Bennett | |
| 6,234,896 | B1 | 5/2001 | Walker et al. | |
| 6,244,957 | B1 | 6/2001 | Walker et al. | |
| 6,254,483 | B1 | 7/2001 | Acres | |
| 6,257,981 | B1 | 7/2001 | Acres et al. | |
| 6,270,409 | B1 | 8/2001 | Shuster | |
| 6,273,820 | B1 | 8/2001 | Haste, III | |
| 6,309,300 | B1 * | 10/2001 | Glavich | 463/26 |
| 6,375,567 | B1 | 4/2002 | Acres | |
| 6,695,697 | B1 | 2/2004 | Okada | |
| 6,932,704 | B2 | 8/2005 | Walker et al. | |
| 6,932,707 | B2 | 8/2005 | Duhamel | |
| 2003/0045349 | A1 * | 3/2003 | Hughs-Baird | 463/25 |
| 2003/0069073 | A1 | 4/2003 | Okada | |
| 2004/0048646 | A1 * | 3/2004 | Visocnik | 463/16 |
| 2006/0189380 | A1 * | 8/2006 | Schultz et al. | 463/20 |
| 2006/0205495 | A1 | 9/2006 | Fujimoto | |
| 2006/0211485 | A1 | 9/2006 | Fujimoto | |
| 2007/0060254 | A1 * | 3/2007 | Muir | 463/16 |
| 2007/0218982 | A1 * | 9/2007 | Baerlocher | 463/27 |
| 2009/0011826 | A1 * | 1/2009 | Acres | 463/27 |
| 2009/0042641 | A1 * | 2/2009 | Anderson et al. | 463/25 |
| 2009/0069063 | A1 * | 3/2009 | Thomas et al. | 463/16 |

FOREIGN PATENT DOCUMENTS

| | | | |
|---|---|---|---|
| DE | 3712841 | | 11/1988 |
| DE | 4137010 | | 8/1992 |
| DE | 10049444 | | 11/2001 |
| EP | 0 631 798 | A1 | 1/1995 |
| EP | 0 840 264 | A1 | 5/1998 |
| EP | 1 192 975 | A1 | 4/2002 |
| EP | 1 302 914 | A2 | 4/2003 |
| EP | 1 351 180 | A2 | 10/2003 |
| EP | 1 477 947 | A2 | 11/2004 |
| EP | 1 544 811 | A2 | 6/2005 |
| GB | 2 326 830 | A | 1/1999 |
| WO | WO 03/083795 | A1 | 10/2003 |
| WO | WO2004/095383 | A1 | 11/2004 |

* cited by examiner

FIG. 24

PAYOUT TABLE

| ALL PAYS ON PAYLINE | 1ST Credit | 2ND Credit | 3RD Credit |
|---|---|---|---|
| DOUBLE DOUBLE DOUBLE | 800 | 1600 | 2400 |
| BAR BAR BAR<br>BAR BAR BAR<br>BAR BAR BAR | 60 | 120 | 180 |
| BAR BAR BAR<br>BAR BAR BAR | 30 | 60 | 90 |
| | 20 | 40 | 60 |
| BAR BAR BAR | 15 | 30 | 45 |
| ANY ANY ANY<br>BAR BAR BAR | 5 | 10 | 15 |
| ANY 2 | 5 | 10 | 15 |
| ANY 1 | 2 | 4 | 6 |

GAMING MACHINE WITH A COUNT-VALUE TRIGGERED INSURANCE BONUS GAME AND PLAYING METHOD THEREOF

CROSS-REFERENCE TO RELATED APPLICATION

This application is based upon and claims the benefit of U.S. Provisional Patent Application Ser. No. 60/907,685, filed on Apr. 13, 2007; the entire contents of which are incorporated herein by reference for all purposes.

BACKGROUND OF THE INVENTION

1. Field of the Invention

The present invention relates to a gaming machine with which a wager for insurance pay can be placed and a playing method thereof.

2. Description of the Related Art

At a facility where gaming machines such as slot machines are installed, a player can play a game by placing a wager (coins or credits etc.) on the gaming machine. (For example, a gaming machine such as slot machines is disclosed in U.S. Pat. No. 5,820,459, U.S. Pat. No. 6,695,697, U.S. Laid-Open Patent Application No. 2003/0069073, European Laid-Open Patent Application No. 1192975, U.S. Pat. No. 6,254,483, U.S. Pat. No. 5,611,730, U.S. Pat. No. 5,639,088, U.S. Pat. No. 6,257,981, U.S. Pat. No. 6,234,896, U.S. Pat. No. 6,001,016, U.S. Pat. No. 6,273,820, U.S. Pat. No. 6,224,482, U.S. Pat. No. 4,669,731, U.S. Pat. No. 6,244,957, U.S. Pat. No. 5,910,048, U.S. Pat. No. 5,695,402, U.S. Pat. No. 6,003,013, U.S. Pat. No. 4,283,709, European Laid-Open Patent Application No. 0631798, German Laid-Open Patent Application No. 4137010, Great Britain Laid-Open Patent Application No. 2326830, German Laid-Open Patent Application No. 3712841, U.S. Pat. No. 4,964,638, U.S. Pat. No. 6,089,980, U.S. Pat. No. 5,280,909, U.S. Pat. No. 5,702,303, U.S. Pat. No. 6,270,409, U.S. Pat. No. 5,770,533, U.S. Pat. No. 5,836,817, U.S. Pat. No. 6,932,704, U.S. Pat. No. 6,932,707, U.S. Pat. No. 4,837,728, European Laid-Open Patent Application No. 1302914, U.S. Pat. No. 4,624,459, U.S. Pat. No. 5,564,700, PCT Laid-Open Application No. 03/083795, German Laid-Open Patent Application No. 3242890, European Laid-Open Patent Application No. 0840264, German Laid-Open Patent Application No. 10049444, PCT Laid-Open Application No. 04/095383, European Laid-Open Patent Application No. 1544811, U.S. Pat. No. 5,890,963, European Laid-Open Patent Application No. 1477947, and European Laid-Open Patent Application No. 1351180.)

With a slot machine, for example, each time the player places a wager and presses a start switch, a unit game is executed for rearranging a plurality of symbols on a display. Then, when the combination of the rearranged symbols turns out to be a predefined winning combination, a payout is provided to the player according to the winning combination.

Furthermore, a jackpot payout may be also provided. In other words, a portion of the wager is accumulated for the jackpot in the slot machine. Then, whether or not to provide a payout of the jackpot is determined at a predefined timing, and the accumulated credits for the jackpot are provided to the player when it is determined to provide the payout.

SUMMARY OF THE INVENTION

With a gaming machine according to a first aspect of the present invention, a wager for an insurance pay can be placed. The gaming machine comprises: a display for displaying an image relating to a unit game, in which it is determined whether or not a payout is awarded; an input switch for placing the wager for the insurance pay; a counter for accumulating a count-value with successive execution of the unit games after the wager is placed, and resetting the count-value when a predefined reset condition is met; and a controller. The controller is operable to: (a) provide a predefined payout to a player when an outcome of the unit game turns out to be a specific outcome; (b) receive the wager for the insurance pay via the input switch; (c) execute transition into a second game, when the count-value reaches a predefined value in the unit game with the wager for the insurance pay; and (d) provide the insurance pay according to an outcome of the second game.

With a gaming machine according to a second aspect of the present invention, a wager for an insurance pay can be placed. The gaming machine comprises: a display for displaying an image relating to a unit game, in which it is determined whether or not a payout is awarded; an input switch for placing the wager for the insurance pay; a counter for accumulating a count-value with successive execution of the unit games with the wager after the wager is placed, and resetting the count-value when a predefined reset condition is met; and a controller. The controller operable to: (a) provide a predefined payout to a player when an outcome of the unit game turns out to be a specific outcome; (b) receive the wager for the insurance pay via the input switch; (c) execute transition into a second game, when the count-value reaches a predefined value in the unit game with the wager for the insurance pay; and (d) provide the insurance pay according to an outcome of the second game.

With a gaming machine according to a third aspect of the present invention, a wager for an insurance pay can be placed. The gaming machine comprises: a display for displaying an image relating to a unit game, in which it is determined whether or not a payout is awarded; an input switch for placing the wager for the insurance pay; a counter for accumulating a count-value with successive execution of the unit games after the wager is placed, and resetting the count-value when a predefined reset condition is met; and a controller. The controller is operable to: (a) provide a predefined payout to a player when an outcome of the unit game turns out to be a specific outcome; (b) receive the wager for the insurance pay via the input switch; (c) execute transition into a second game, when the count-value reaches a predefined value in the unit game with the wager for the insurance pay; and (d) provide the insurance pay with coins or medals according to an outcome of the second game.

A playing method of a gaming machine, which executes unit games successively and with which a wager for an insurance pay can be placed, according to a fourth aspect of the present invention comprises: placing a bet on a unit game; providing a predefined payout to a player when an outcome of the unit game turns out to be a specific outcome; placing the wager for the insurance pay; accumulating a count-value with successive execution of the unit games after the wager is placed, the count-value being reset when a predefined reset condition is met; executing transition into a second game, when the count-value reaches a predefined value in the unit game with the wager for the insurance pay; and providing the insurance pay according to an outcome of the second game.

A playing method of a gaming machine, which executes unit games successively and with which a wager for an insurance pay can be placed, according to a fifth aspect of the present invention comprises: placing a bet on a unit game; providing a predefined payout to a player when an outcome of the unit game turns out to be a specific outcome; placing the wager for the insurance pay; accumulating a count-value with successive execution of the unit games with the wager after the wager is placed, the count-value being reset when a predefined reset condition is met; executing transition into a second game, when the count-value reaches a predefined value in the unit game with the wager for the insurance pay; and providing the insurance pay according to an outcome of the second game.

A playing method of a gaming machine, which executes unit games successively and with which a wager for an insurance pay can be placed, according to a sixth aspect of the present invention comprises: placing a bet on a unit game; providing a predefined payout to a player when an outcome of the unit game turns out to be a specific outcome; placing the wager for the insurance pay; accumulating a count-value with successive execution of the unit games after the wager is placed, the count-value being reset when a predefined reset condition is met; executing transition into a second game, when the count-value reaches a predefined value in the unit game with the wager for the insurance pay; and providing the insurance pay with coins or medals according to an outcome of the second game.

BRIEF DESCRIPTION OF THE DRAWINGS

FIG. 24 is a payout table illustrating the relationship between a winning combination and a payout of the slot machine according to one embodiment of the present invention.

DETAILED DESCRIPTION OF THE EMBODIMENTS

Figure 1:
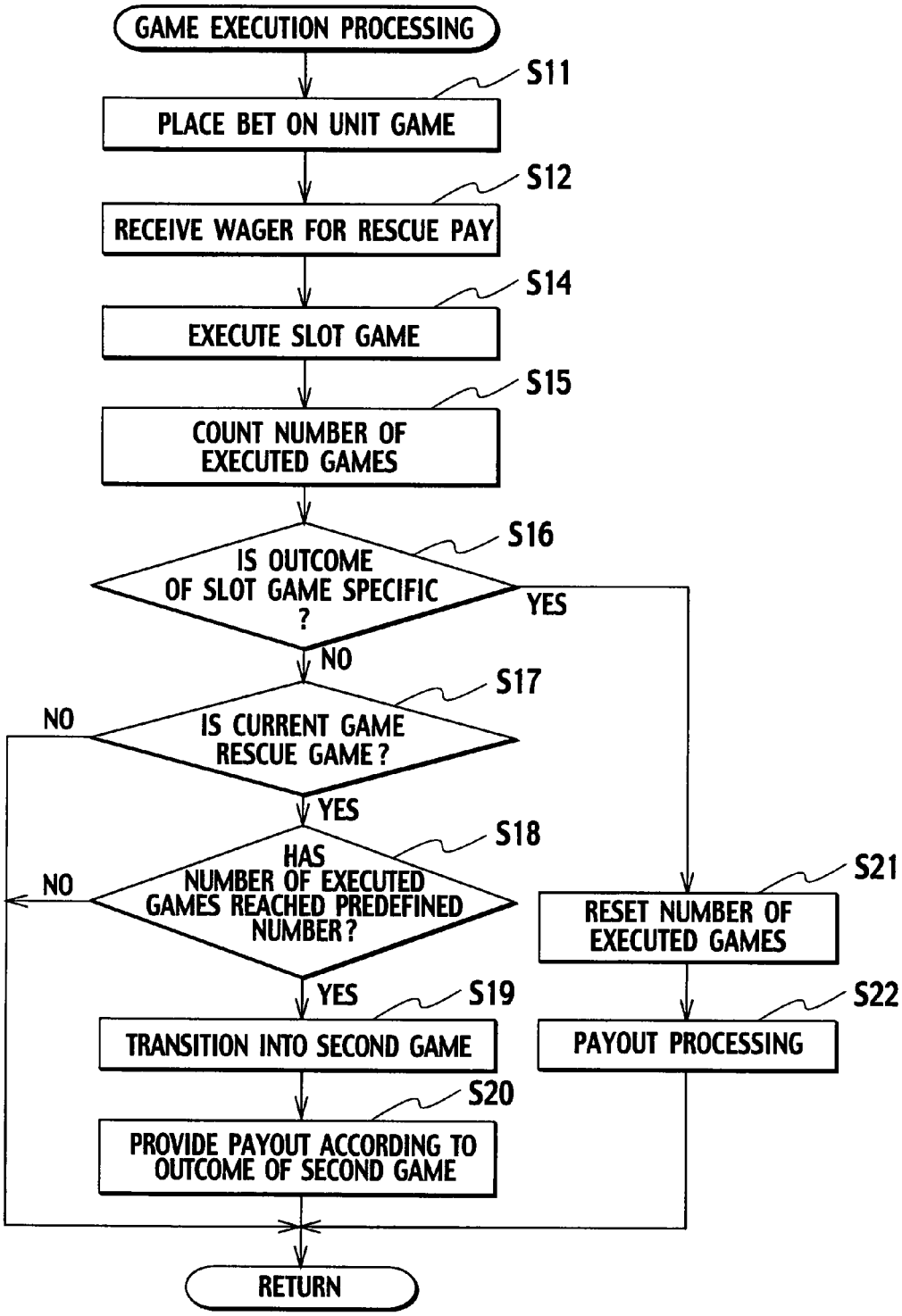
FIG. 1 is a flow chart illustrating the overview procedures of a slot machine according to one embodiment of the present invention.

The outline of the operation of the slot machine, which is an example of the gaming machine according to the present invention, will be described below with reference to the flow chart of FIG. 1 and the perspective view of a slot machine 10 of FIG. 2.

First, the slot machine 10 of the present embodiment receives a bet on a unit game, which is an executing unit of slot games (step S11). Specifically, medals or coins are inserted, or a bet of monetary information (credits) is received.

Subsequently, the slot machine receives a wager for an insurance pay (referred to as "rescue pay" hereinafter; "insurance pay" and "rescue pay" are both pending applications for trademark registration) (step S12). Here, the wager for the insurance pay is placed by a player's insurance pay setup operation as described below. The term "rescue pay" means, as described below, a payout provided to the player according to an outcome of a second game (e.g., equivalent to 360 medals). Here, the second game is executed when the number of unit games without a predefined payout amount (e.g., corresponding to 60 or more medals per bet) has reached an upper limit (e.g., 1000 games).

Next, the slot machine executes a slot game (step S14). In the slot game with the wager for the rescue pay, similarly with the slot game without the wager for the rescue pay, symbols are scrolled on each of three display areas Q1 to Q3 triggered by the player's pressing down a start switch 27, and are subsequently stopped. Then, if the combination of the symbols displayed on the display areas Q1 to Q3 (outcome of the slot game) turns out to be a winning combination, a payout is provided to the player according to the winning combination.

Subsequently, the number of executed games (or expended bet amount) is counted (step S15). Next, it is determined whether or not the outcome of the slot game is a specific outcome (step S16). Here, "specific outcome" is, for example, a case in which the payout per credit reaches or exceeds 60. Specifically, it is a case when "DOUBLE" (specific symbol) or "triple BAR" (specific symbol) shown in FIG. 26 has aligned across the three display areas Q1 to Q3.

Then, in the case of the specific outcome (YES in step S16), the number of executed games (or expended bet amount) counted in the processing in step S15 is reset (step S21). Subsequently, a payout is provided to the player according to the specific outcome (step S22).

On the other hand, if the outcome of the game is not a specific outcome (NO in step S16), it is determined whether or not the current game is a game with a rescue pay (referred to as a "rescue game", hereinafter) (step S17). In case of the rescue game, it is determined whether or not the number of executed games has reached an upper limit (predefined value) (step S18).

Then, if the number of executed games has reached the upper limit, the game transits into the second game (step S19). In the second game, one of the three cards is selected by the player. Each of the three cards has been assigned a predefined different insurance pay amount. The insurance pay amount to be provided to the player is determined in this way (see FIGS. 30A and 30B). In other words, the insurance pay amount varies according to the outcome of the second game. Here, the number of executed games (expended bet amount) counted in step S15 is reset when the game transits into the second game.

Then, the payout according to the outcome of the second game (insurance pay amount determined by selecting one of the three cards) is provided to the player (step S20).

As stated above, the rescue game can be playable according to the player's intention. The game transits into the second game when the number of executed games or expended bet amount has reached an upper limit during the rescue games. And then, the insurance pay, which is provided to the player, varies according to the outcome of the second game.

Next, an arrangement of the slot machine 10 of the present embodiment will be described in detail.

Figure 2:
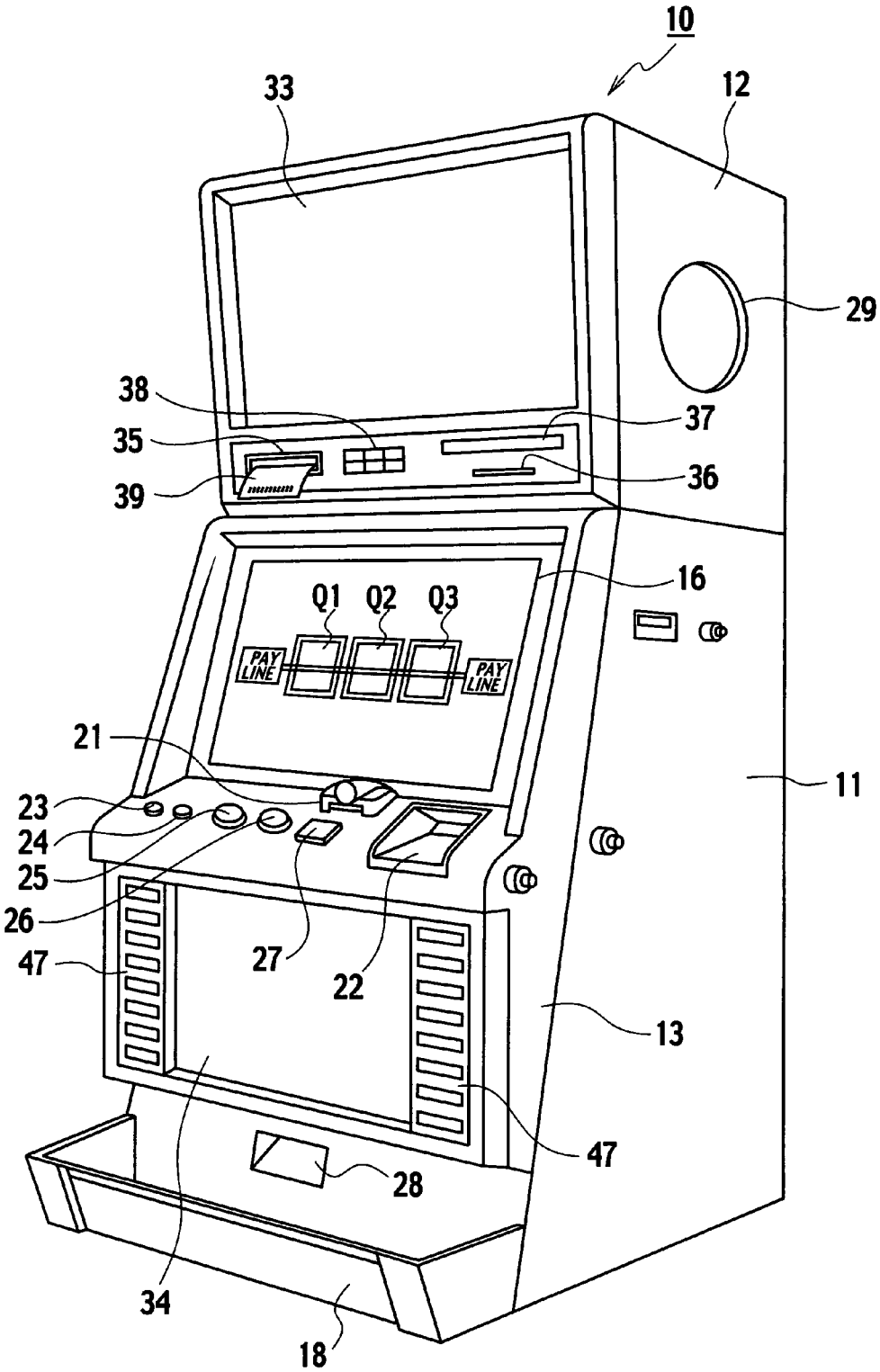
FIG. 2 is a perspective view illustrating an arrangement of the slot machine according to one embodiment of the present invention.

A slot machine 10 of the present embodiment includes a cabinet 11 and a top box 12 provided on top of the cabinet 11, as shown in FIG. 2. The cabinet 11 has a main door 13. A lower LCD 16 is disposed on the front of the cabinet 11 facing the player. Inside the cabinet 11 are disposed various component devices such as a controller 40 and a hopper 44 (see FIG. 3). The controller 40 electrically controls the slot machine 10. The hopper 44 controls insertion, storage, and payout of medals.

In the present embodiment, medals are used for a wager when playing a game. Gaming media for the wager is not only limited to medals, but coins, tokens, electronic money, or other equivalent electronic value information (credits) may also be used. The main door 13 is attached to the cabinet 11 so that it can be opened and closed.

The lower LCD 16 is disposed on an upper portion of the main door 13. The lower LCD 16 displays images relating to a variety of games including a slot game. In the slot game, symbols are rearranged after being scrolled on each of the three display areas Q1 to Q3 arranged laterally. Then, a predefined payout is provided to the player (with medals or credits) if the combination of the symbols rearranged on the display areas Q1 to Q3 turns out to be a winning combination (see FIG. 24).

A medal insertion slot 21 and a bill validator 22 are disposed at a lower part of the lower LCD 16. Medals are inserted into the medal insertion slot 21 when playing a game. The bill validator 22 validates bills and accepts valid ones. Various operational switches are disposed nearby the medal insertion slot 21 and the bill validator 22.

A cash-out switch 23, a max bet switch 24, a bet switch 25, a repeat bet switch 26, and a start switch 27 are provided as operational switches.

The bet switch 25 is a switch for determining credits to be bet on the slot game, which is executed on the lower LCD 16. Each time the bet switch 25 is pressed, a credit equivalent to one medal is bet.

The Repeat bet switch 26 is a switch for placing a bet with the credits as bet on the previous game.

The start switch 27 is a switch for starting the slot game on the lower LCD 16 after credits are bet. After the medal(s) is inserted into the medal insertion slot 21 or credits are bet by the bet switch 25, the slot game on the display areas Q1 to Q3 of the lower LCD 16 is started by pressing the start switch 27.

The cash-out switch 23 is a switch for paying out medals. The medals are paid out onto a medal tray 18 from a medal cash-out opening 28 disposed on the front lower part of the main door 13.

The max bet switch 24 is a switch for placing a bet with maximum credits (e.g., three medals) that can be bet on a single game by one pressing. The maximum credits that can be bet on a single slot game may be changed by operation of the administrator. For example, credits equivalent to 50 medals can be bet.

A foot display 34 is disposed on the lower front of the main door 13. Various images relating to the game (such as characters of the slot machine 10) are displayed on the foot display 34.

Lamps 47 are provided on both sides of the foot display 34. The lamp 47 emits light based on a preset light emission pattern. The medal cash-out opening 28 is provided on the lower part of the foot display 34.

An upper LCD 33 is disposed on the front of the top box 12. The number of medals to be paid out according to the combination of the symbols and other effect images are displayed on the upper LCD 33.

Speakers 29 are provided on the top box 12. A ticket printer 35, a card reader 36, a data display 37, and a keypad 38 are disposed on the lower part of the upper LCD 33. The ticket printer 35 prints out a ticket 39 having data such as a possessing credit value, time and date, identification number of the slot machine 10 printed thereon as a bar code.

The player can play a game at another slot machine by using the bar-coded ticket 39, and exchange the bar-coded ticket 39 for bills at a predefined site in an amusement facility (e.g., a cashier in the casino).

A smart card can be inserted into the card reader 36. The card reader 36 reads the data from the smart card and writes the data onto the smart card. The smart card is carried by the player. The smart card stores the player's identification data and gaming history data.

Figure 3:
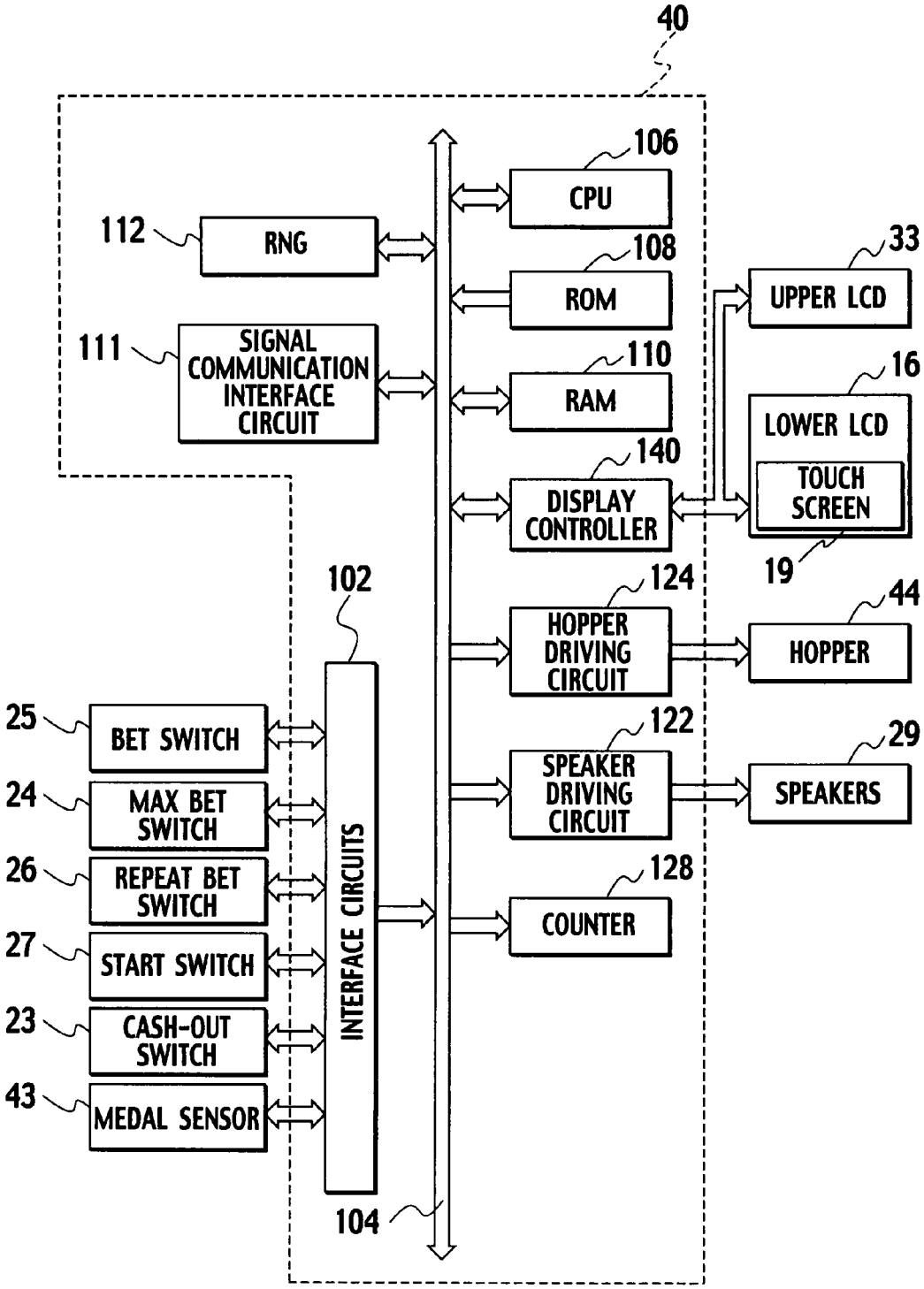
FIG. 3 is a block diagram illustrating a configuration of a control circuit of the slot machine according to one embodiment of the present invention.

FIG. 3 is a block diagram illustrating the electric configuration of the controller 40 and various devices connected to the controller 40, which are provided in the slot machine 10 of the present embodiment. The controller 40 shown in FIG. 3 is a microcomputer. The controller 40 includes interface circuits 102, an I/O bus 104, a CPU 106, a ROM 108, a RAM 110, a signal communication interface circuit 111, a random number generator (RNG) 112, a speaker drive circuit 122, a hopper drive circuit 124, a counter 128, and a display controller 140.

The interface circuits 102 are connected to the I/O bus 104. The I/O bus 104 executes input and output of data signals and address signals with the CPU 106.

The start switch 27 is connected to the interface circuits 102. The start signal output from the start switch 27 is transmitted to the CPU 106 via the I/O bus 104, after having been converted into a predefined signal by the interface circuits 102.

The bet switch 25, the max bet switch 24, the repeat bet switch 26, and the cash-out switch 23 are connected to the interface circuit 102. The switching signal output from each of the switches 23-26 is transmitted to the CPU 106 via the I/O bus 104, after having been converted into a predefined signal by the interface circuits 102.

A medal sensor 43 is connected to the interface circuits 102. The medal sensor 43 detects medals, which have been inserted into the medal insertion slot 21. The medal sensor 43 is provided inside the medal insertion slot 21. The detection signal output from the medal sensor 43 is transmitted to the CPU 106 via the I/O bus 104, after having been converted into a predefined signal by the interface circuits 102.

The ROM 108 storing a system program and the RAM 110 storing various data are connected to the I/O bus 104. The RNG 112, the signal communication interface circuit 111, the display controller 140, the hopper drive circuit 124, the speaker drive circuit 122, and the counter 128 are also connected to the I/O bus 104.

The CPU 106, triggered by receiving the start signal from the start switch 27, reads a game execution program and executes a slot game. The game execution program is a program for executing the slot game on the lower LCD 16 through the display controller 140.

In other words, the game execution program is programmed so as to execute a slot game in which the symbols come to a stop after scrolling (the symbols which have been arranged are rearranged) on respective display areas Q1 to Q3 (see FIG. 2) and a payout will be awarded when a winning combination is formed by the rearranged symbols.

The signal communication interface circuit 111, which is connected to a hall server etc., transmits gaming history data etc. of the slot machine 10 to the hall server. The signal communication interface circuit 111 receives various data transmitted from the hall server. Based on the random number generated by the RNG 112, it is determined whether or not to award a winning combination in the slot game on the lower LCD 16.

The counter 128 has the functions of (i) counting the number of times the unit game is executed (number of slot games executed on the display areas Q1 to Q3=number of executed games), (ii) counting the number of inserted medals during successively executed slot games, and (iii) counting the difference between the number of inserted medals and the number of paid-out medals during successively executed slot games. The "number of inserted medals during successively executed slot games" is an accumulated value of the inserted medals. For example, if the slot game is executed ten times with three medals (credits) bet on each game, the number of inserted medals will be 30. Also, the "difference between the number of inserted medals and the number of paid-out medals during successively executed slot games" is an accumulated value of difference value which is got by subtracting the number of paid-out medals from the inserted medals (in other words, a difference value which is got by subtracting the accumulated number of the paid-out medals from the accumulated number of the inserted medals). For example, if the slot game is executed ten times with three medals (credits) bet on each game, and a payout of ten medals (credits) is provided during the ten games, the difference will be 20. The counter 128 can be implemented inside the RAM 110.

The speaker drive circuit 122 outputs audio data to the speakers 29. In other words, the CPU 106 reads the audio data stored in the ROM 108 and transmits the audio data to the speaker drive circuit 122 via the I/O bus 104. In this manner, predefined sound effects are output from the speakers 29.

The hopper drive circuit 124 outputs a cash-out signal to the hopper 44 when providing a cash-out. In other words, the cash-out signal is output by pressing the cash-out switch 23. The CPU 106 outputs, when the cash-out signal is input, a drive signal to the hopper drive circuit 124 via the I/O bus 104. As a result, the hopper 44 cash out medals equivalent to the credits stored in a predefined memory area of the RAM 110.

The display controller 140 controls display of the slot game executed on the lower LCD 16. In other words, the CPU 106 generates an image display signal according to the progress and outcome of the slot game and outputs the image display signal to the display controller 140 via the I/O bus 104. Upon input of the image display signal, the display controller 140 generates a drive signal of the lower LCD 16 based on the image display signal and outputs it to the lower LCD 16. In this manner, various images such as effect images or explanatory images of the game are displayed on the lower LCD 16.

A touch-screen 19 is provided on the surface of the lower LCD 16. When the player touches the touch-screen 19, the touch position is detected and transmitted as data to the CPU 106.

In addition, the display controller 140 also controls display of various images such as effect images or explanatory images of the game on the upper LCD 33.

Next, the processing procedures according to a first embodiment for executing the unit game on the above-mentioned slot machine 10 will be described, referring to FIGS. 4 to 9.

Figure 4:
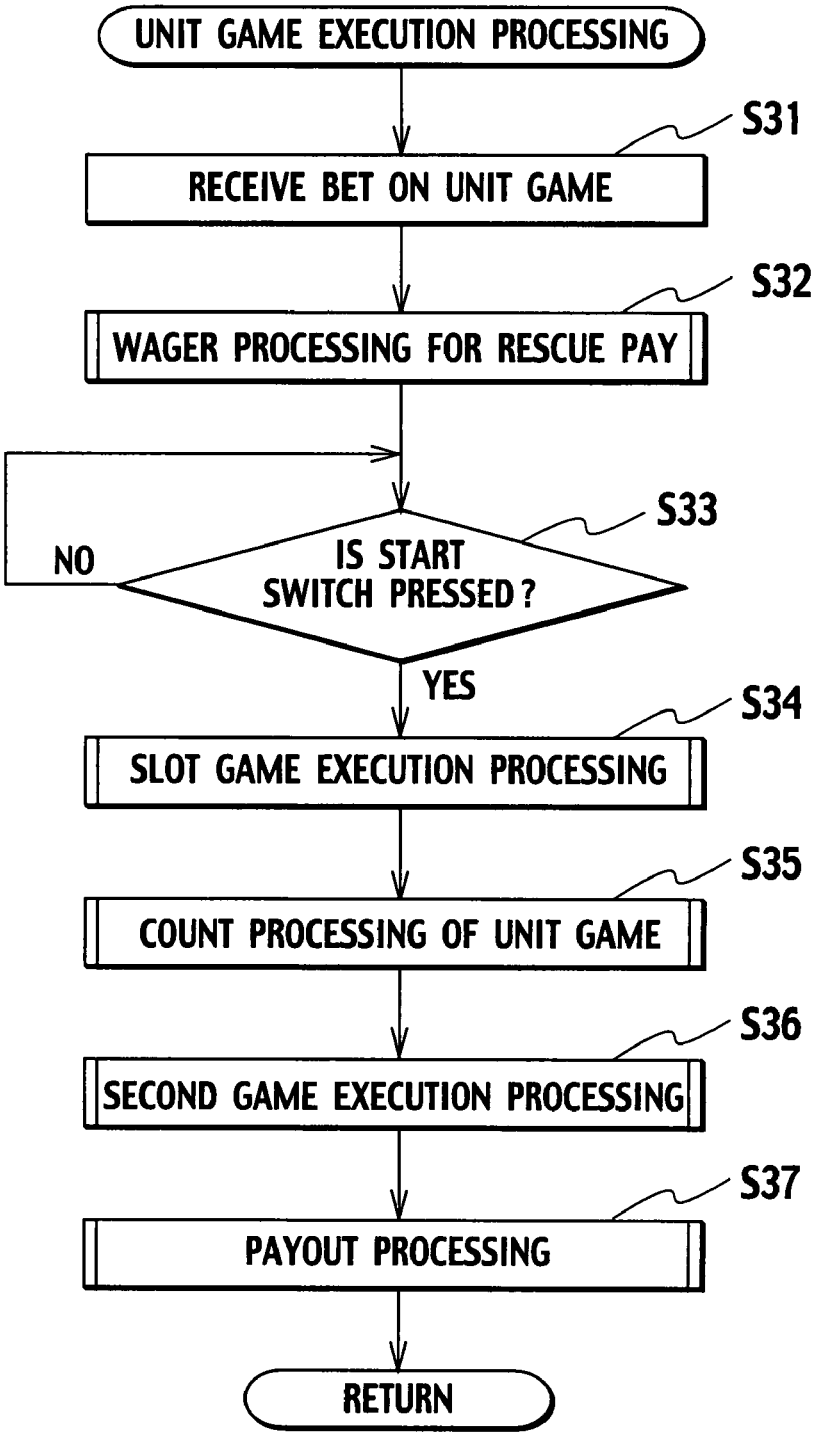
FIG. 4 is a flow chart illustrating the processing procedure according to one embodiment of the present invention.

A bet on the unit game is firstly received (step S31 in FIG. 4). Specifically, the insertion of the medal(s) into the medal insertion slot 21 or the pressing-down of the bet switches 24, 25 is detected by the CPU 106.

Next, a wager processing for the rescue pay is executed (step S32). Here, the wager for the rescue pay is received via the touch-screen 19 on the lower LCD 16. The details will be described below, referring to the flow chart shown in FIG. 5.

Subsequently, it is determined whether or not the start switch 27 is pressed (step S33). If the start switch 27 is pressed, the processing proceeds to step S34.

Next, a slot game execution processing is executed (step S34). Here, a processing of rearranging the symbols having been arranged on respective three display areas Q1 to Q3 is executed. The details will be described below referring to the flow chart shown in FIG. 6.

Next, a count processing of the unit game is executed (step S35). In this processing, the count-value of the counter 128 is incremented each time the unit game is executed. The details will be described below, referring to the flow chart of FIG. 7.

Next, a second game execution processing is executed (step S36). In this processing, if a payout equal to or larger than a specified amount (e.g., corresponding to 60 or more medals per one medal) is not provided during a predefined number of executed unit games (e.g., 1000 games), the game transits into a second game and the second game execution processing will be executed. The details will be described referring to the flow chart of FIG. 8.

Next, a payout processing is executed (step S37). In this processing, if a winning combination is formed by the rearranged symbols on the three display areas Q1 to Q3, or if the progressive bonus is awarded, a payout is provided (as medals or credits) to the player. Subsequently, the processing proceeds to the next unit game.

Figure 5:
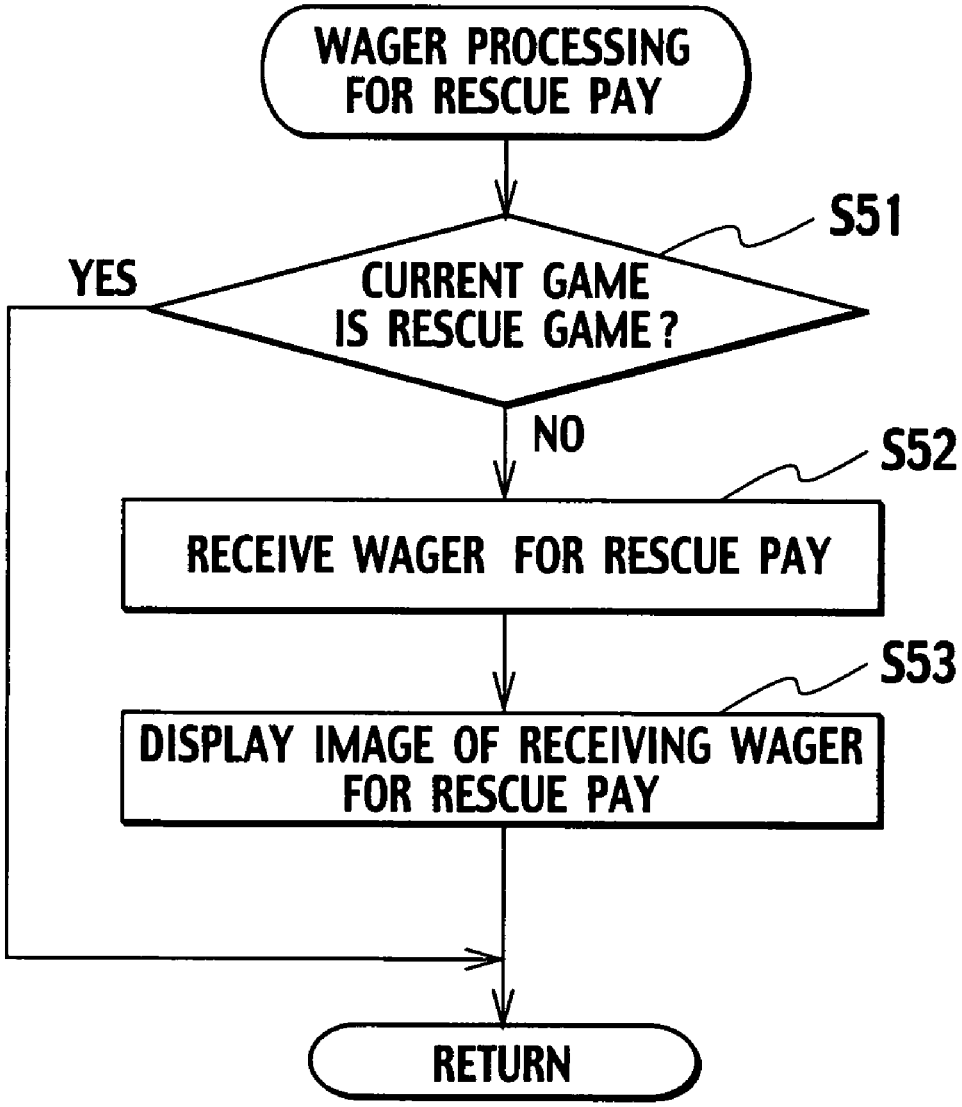
FIG. 5 is a flow chart illustrating the processing procedure according to one embodiment of the present invention.

FIG. 5 shows a flow chart of the wager processing for the rescue pay in step S32 of FIG. 4. First, it is determined whether or not the current unit game is a rescue game (step S51). Then, if the current unit game is not the rescue game (NO in step S51), the processing proceeds to step S52. On the other hand, if the current unit game is a rescue game (YES in step S51), the processing is completed.

If the determination of step S51 is negative, a wager for the rescue pay is received (step S52). Next, an image notifying acceptance of the wager for the rescue pay is displayed on the upper LCD 33 and the lower LCD 16 (step S53).

Figure 25A:
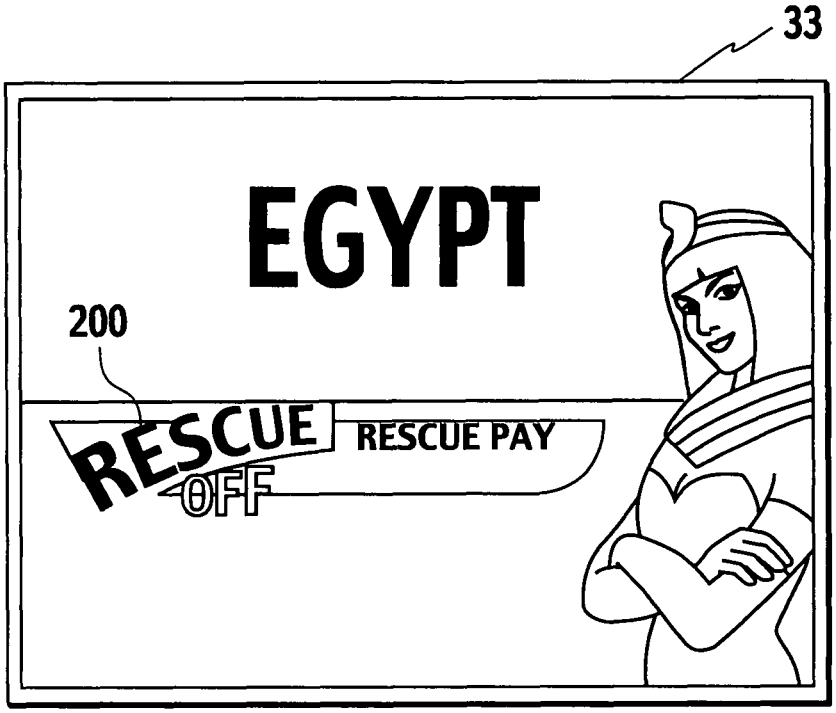
FIG. 25A is an exemplary display displayed on an LCD of the slot machine according to one embodiment of the present invention.
Figure 25B:
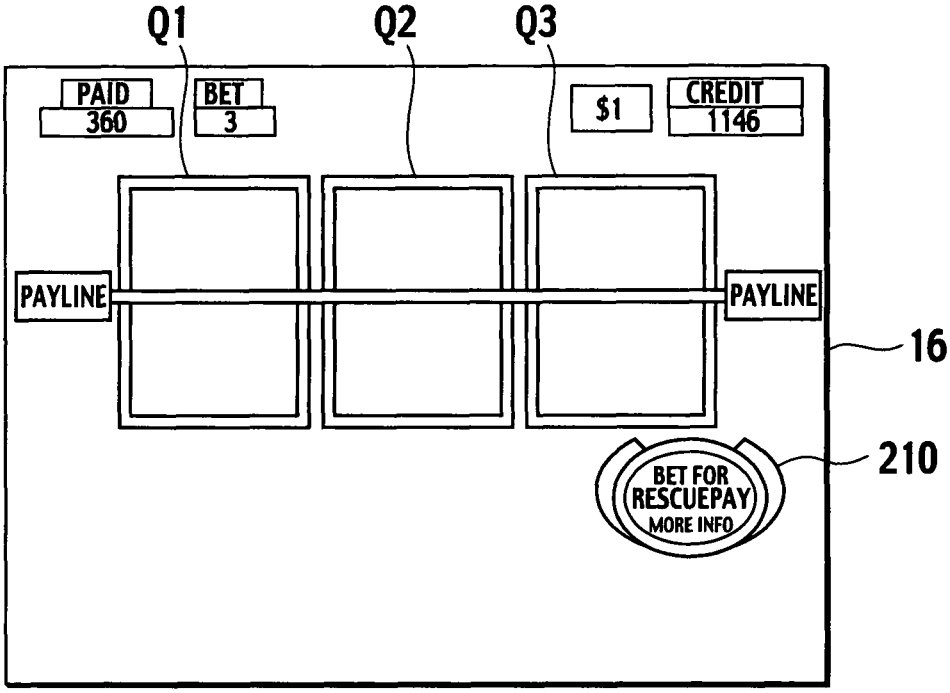
FIG. 25B is an exemplary display displayed on an LCD of the slot machine according to one embodiment of the present invention.

FIG. 25A shows the exemplary image displayed on the upper LCD 33. FIG. 25B shows the exemplary image displayed on the lower LCD 16. In FIG. 25A, a "RESCUE OFF" image 200 is displayed indicating a state that a wager for the rescue pay has not currently been placed. Additionally, in FIG. 25B, a button 210 for presenting explanation of the rescue pay is displayed. When the player touches the button 210, the touch operation is detected by the touch-screen 19 (see FIG. 3).

Figure 26:
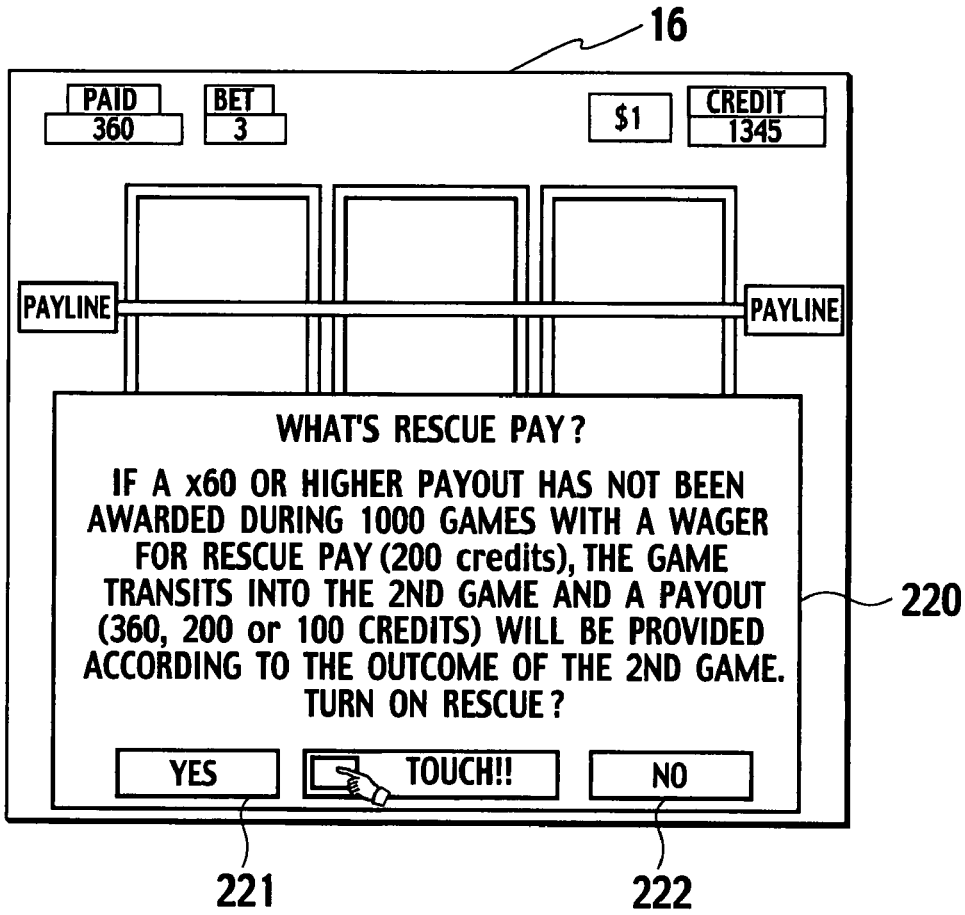
FIG. 26 is an exemplary display displayed on an LCD of the slot machine according to one embodiment of the present invention.

Subsequently, as shown in FIG. 26, an explanatory image 220 of the rescue pay is displayed. In this example, a statement "What's rescue pay? If a ×60 or higher payout has not been awarded during 1000 games with a wager for rescue pay (200 credits), the game transits into the 2nd game and a payout (360, 200 or 100 credits) will be provided according to the outcome of the 2nd game. Turn on rescue?" is displayed. In this manner the player is informed of the content of the rescue pay and prompted to select either one of selection images 221 and 222 indicating "YES" or "NO".

Figure 27A:
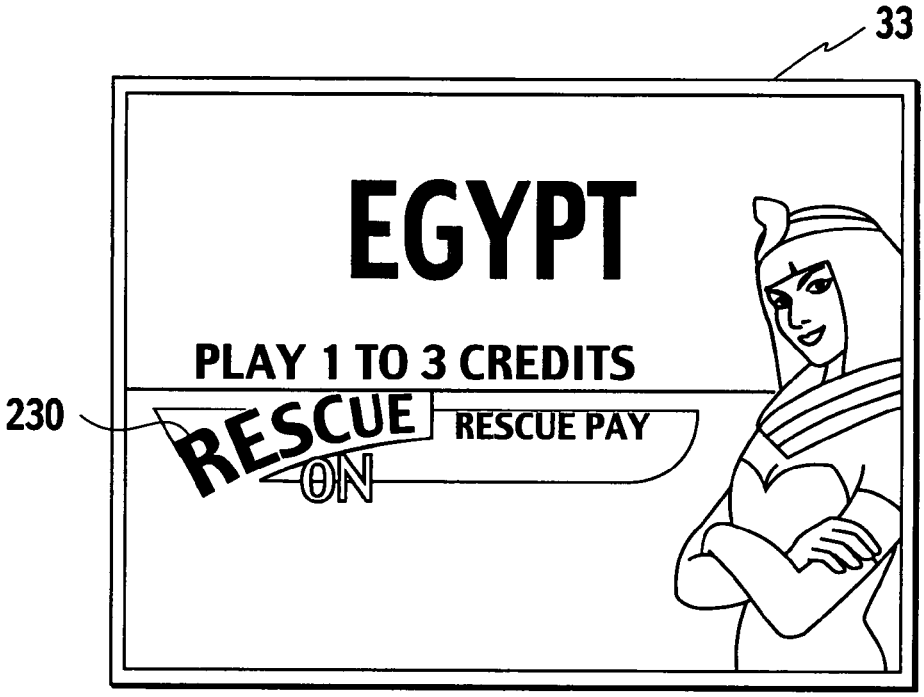
FIG. 27A is an exemplary display displayed on an LCD of the slot machine according to one embodiment of the present invention.
Figure 27B:
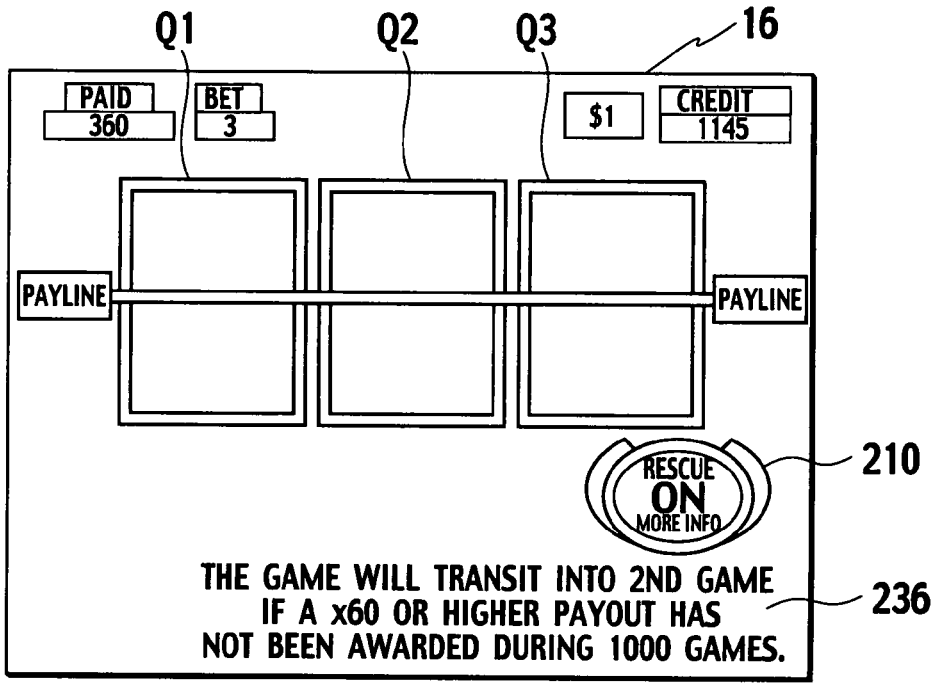
FIG. 27B is an exemplary display displayed on an LCD of the slot machine according to one embodiment of the present invention.

Then, a "RESCUE ON" image 230 is displayed on the upper LCD 33 as shown in FIG. 27A, if a wager for the rescue pay is placed by the player's touching the "YES" image 221 (corresponding to the input switch). Additionally, as shown in FIG. 27B, a statement 236 "The game will transit into the 2nd game if a ×60 or higher payout has not been awarded during 1000 games." is displayed on the lower LCD 16 in order to notify the player that the current unit game is a rescue game.

Figure 6:
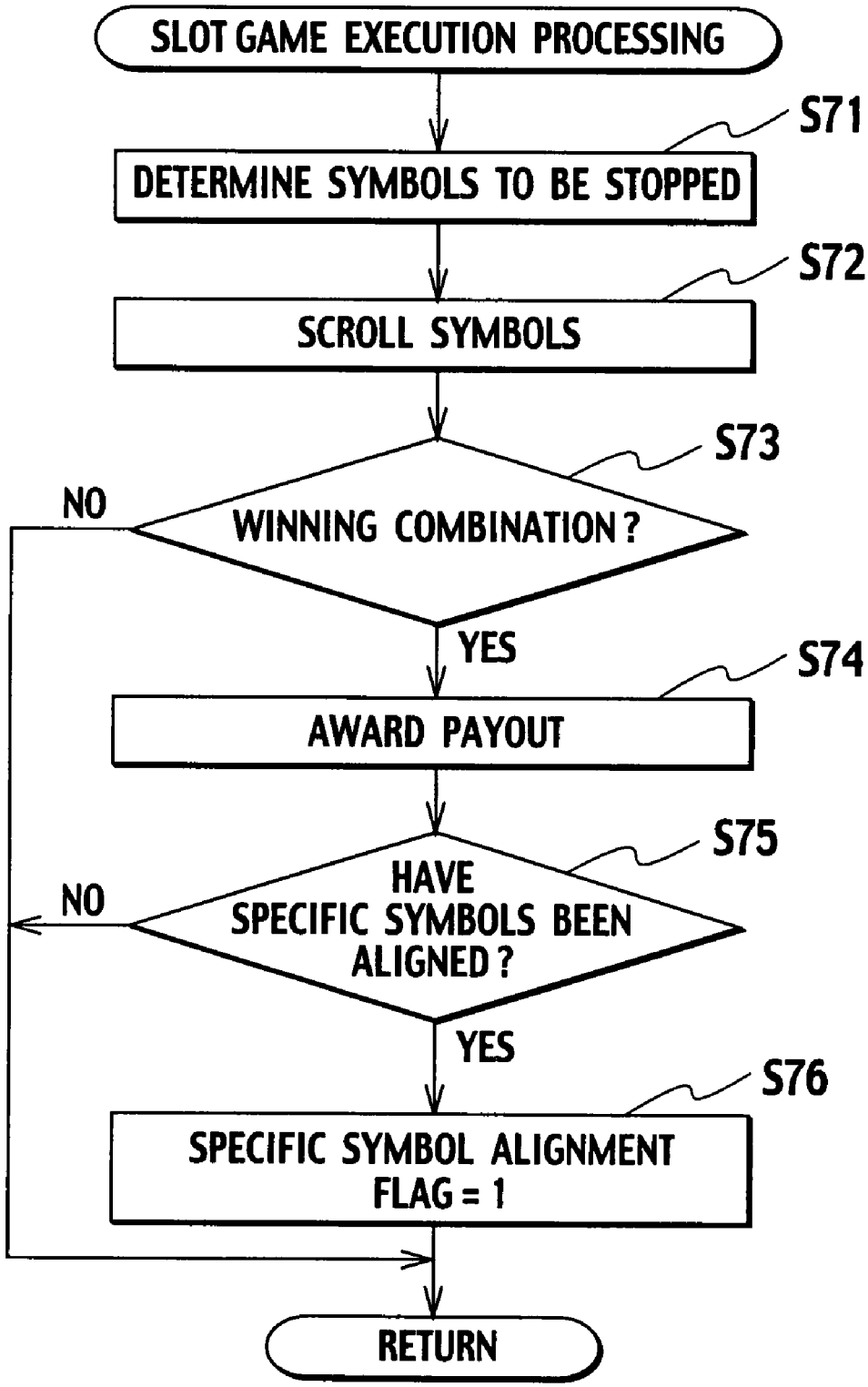
FIG. 6 is a flow chart illustrating the processing procedure according to one embodiment of the present invention.

FIG. 6 shows a flow chart of the execution processing of the slot game in step S34 of FIG. 4. In the following, the execution processing of the slot game will be described in detail with reference to the FIG. 6.

First, the symbols to be stopped on each of the display areas Q1 to Q3 are determined based on the random number generated by the RNG 112 (see FIG. 3) (step S71). Subsequently, the symbols are scrolled on each of the display areas Q1 to Q3, and the scrolling symbols are stopped after a predefined time period (e.g., five seconds) has elapsed (step S72). Here, the stopped symbols have been determined in step S71. Subsequently, the processing proceeds to step S73.

It is determined whether or not a winning combination awarding a payout has been formed on the display areas Q1 to Q3 (step S73). The winning combinations are defined in the payout table shown in FIG. 24. Specifically, each of the payouts is predefined, such as: (i) if three "DOUBLE" symbols are in alignment across the display areas Q1 to Q3, a payout of 800 credits is awarded per one credit; (ii) if three "triple BAR" symbols are in alignment across the display areas Q1 to Q3, a payout of 60 credits is awarded per one credit. Additionally, (iii) if three "double BAR" symbols are in alignment, (iv) if three "CHERRY" symbols are in alignment, (v) if three "single BAR" symbols are in alignment, (vi) if three of any of "triple BAR" symbols, "double BAR" symbols, and "single BAR" symbols are in alignment; (vii) if two "CHERRY" symbols are in alignment, or (viii) if one "CHERRY" symbol has appeared, predefined payouts are awarded respectively.

Subsequently, a processing for providing a payout is executed according to the above-mentioned winning combination (step S74). It is determined whether or not specific symbols have been aligned across the display areas Q1 to Q3 (step S75). In the present embodiment, the specific symbols are the symbols that constitute a winning combination to award a ×60 or higher payout. Thus, as shown in FIG. 24, it is determined that the specific symbols are in alignment when three "DOUBLE" symbols or three "triple BAR" symbols are in alignment.

Next, if it is determined that the specific symbols are in alignment (YES in step S75), the specific symbol alignment flag is set to "1" (step S76). Subsequently, the processing is completed.

In the execution processing of the slot game shown in FIG. 6, a payout for is provided according to a winning combination when the winning combination has been rearranged. Furthermore, when specific symbols (three "DOUBLE" symbols or three "triple BAR" symbols in the present embodiment) which award a larger profit to the player are in alignment, a payout is provided according to the specific symbol and also the specific symbol alignment flag is set to "1".

Figure 7:
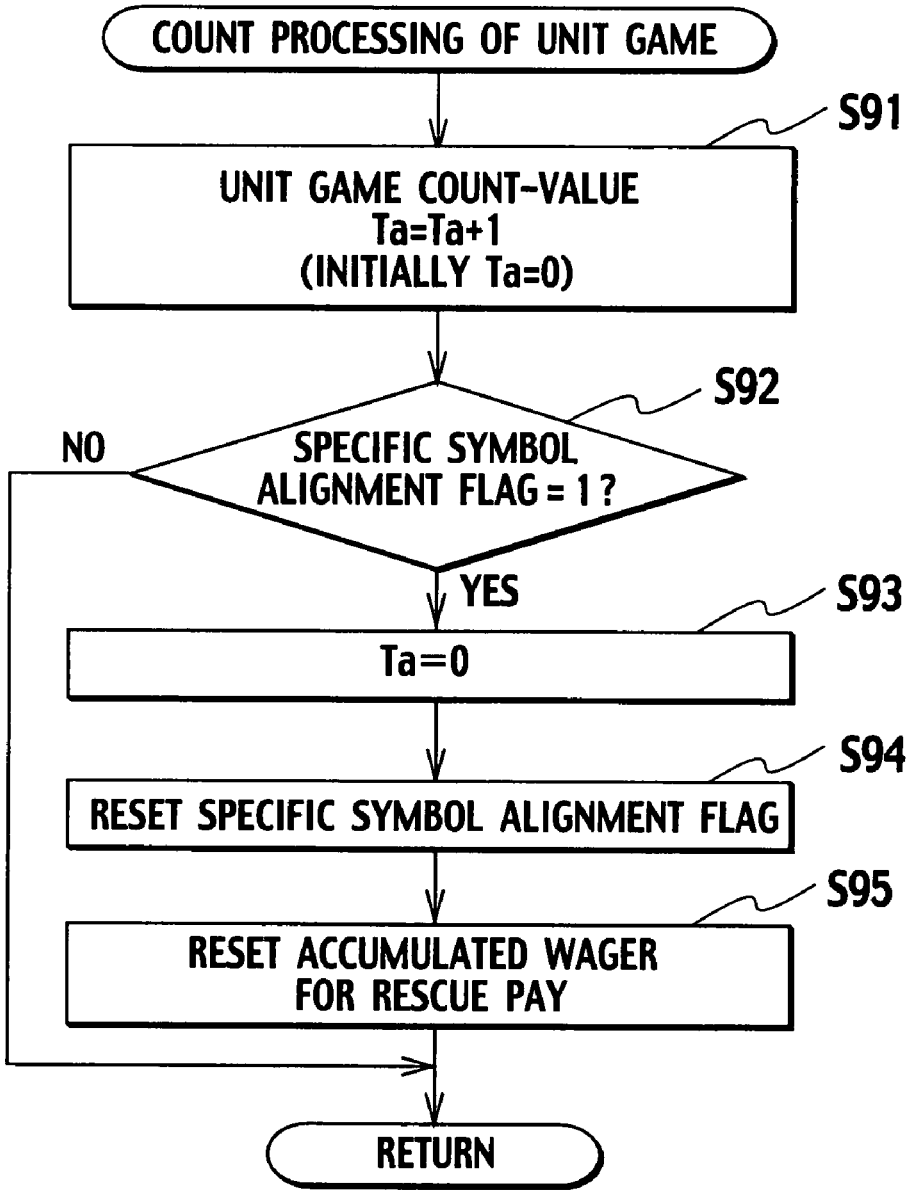
FIG. 7 is a flow chart illustrating the processing procedure according to one embodiment of the present invention.

Next, the count processing of the unit game of step S35 of FIG. 4 will be described with reference to the flow chart shown in FIG. 7.

First, the count-value Ta of the unit game is incremented [Ta=Ta+1] (step S91). Here, the initial value (when the slot machine 10 is powered on) of the count-value Ta is zero. In addition, the count-value Ta is reset in step S93 described below. Note that the count-value Ta is a value for counting the number of executed unit games. Upon completion of step S91, the processing proceeds to step S92.

Next, it is determined whether or not the specific symbol alignment flag is "1" (step S92). In other words, it is determined whether or not the specific symbol alignment flag of step S76 of FIG. 6 is "1". If the specific symbol alignment flag is "1" (YES in step S92), the count-value Ta is reset (step S93).

Furthermore, the specific symbol alignment flag is also reset (step S94). Then, the wager for the rescue pay is also reset (step S95). In other words, if a payout of ×60 or higher is awarded (that is, if the specific symbol alignment flag is "1") (YES in step S92), both the count-value Ta of the unit game and the wager for the rescue pay in step S32 of FIG. 4 are reset.

On the other hand, if the specific symbol alignment flag is not "1" (NO in step 92), the processing is completed. In other words, if the specific symbol alignment flag is not "1" (NO in step S92), the processing is completed and proceeds to the next unit game after the count-value Ta is incremented.

In the above-mentioned count processing of the unit game, if a winning combination with a ×60 or higher payout is not awarded (specific symbols are not aligned), the count-value Ta is incremented. On the other hand, if a winning combination with a ×60 or higher payout is awarded (the specific symbols are in alignment), the count-value Ta is reset. In this manner, the number of successive unit games in which any specific symbols have not been aligned is counted.

Next, the second game execution processing of step S36 of FIG. 4 will be described in detail with reference to the flow chart shown in FIG. 8. First, it is determined whether or not the current unit game is a rescue game (step S101). If the current unit game is a rescue game (YES in step S101), the processing proceeds to step S102. On the other hand, if the current unit game is not a rescue game (NO in step S101), the processing is completed.

If the determination of step S101 is affirmative, it is determined whether or not the count-value Ta is equal to a preset upper limit (predefined value) Tamax (e.g., Tamax=1000) (step S102). Then, if Ta=Tamax (YES in step S102), the processing proceeds to step S103. On the other hand, if not Ta=Tamax (NO in step S102), the processing is completed.

Figure 30A:
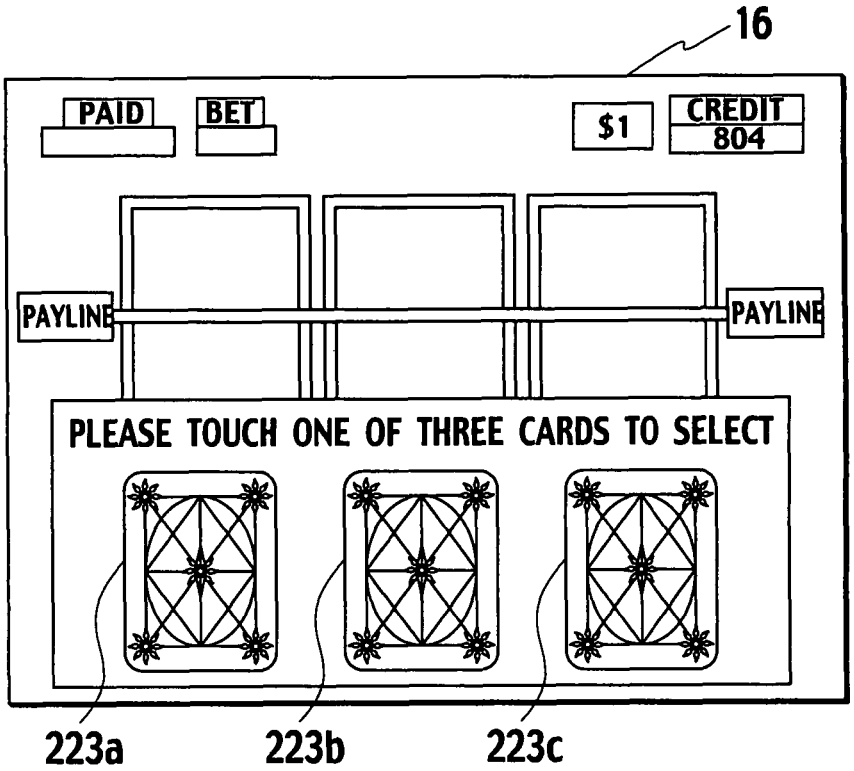
FIG. 30A is an exemplary display displayed on an LCD of the slot machine according to one embodiment of the present invention.
Figure 30B:
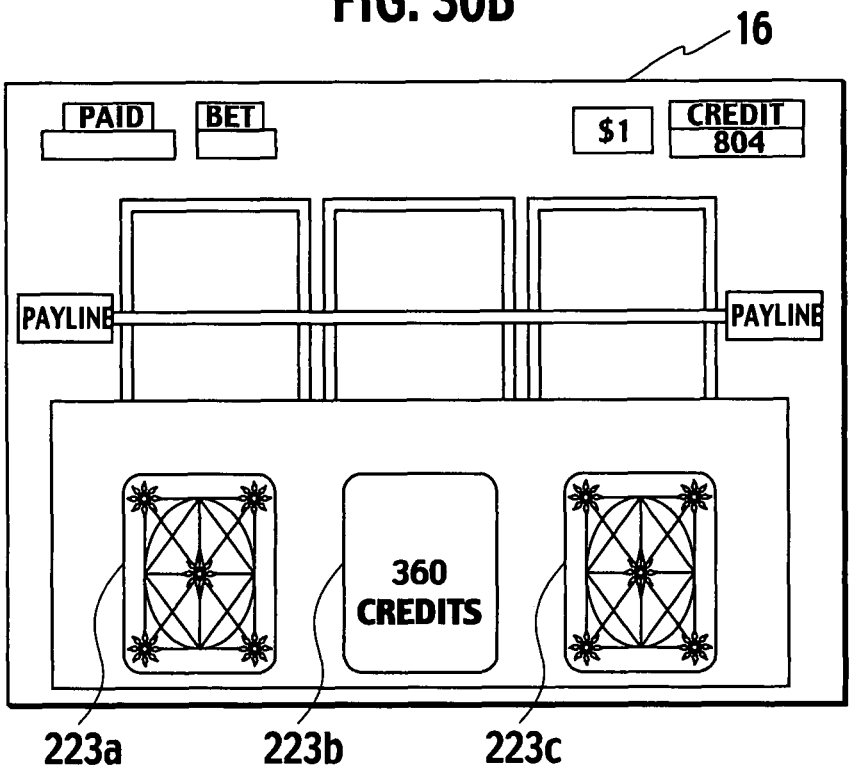
FIG. 30B is an exemplary display displayed on an LCD of the slot machine according to one embodiment of the present invention.

If the determination of step S102 is affirmative, the game transits into the second game and a second game execution processing is executed (step S103). In other words, if the specific symbols have not been aligned although the number of executed games (=the count-value Ta) reaches the upper limit Tamax, a second game such as shown in FIG. 30A or 30B is executed. Here, "the specific symbols are not aligned" means that a winning combination with a ×60 or higher payout is not awarded, specifically. In the second game, one of three turned-back cards 223*a*, 223*b* and 223*c* is turned-up, and the rescue pay (insurance pay) is provided to the player according to the turned-up card. Here, a predefined rescue pay (360, 200 or 100 credits) is assigned to each card. In other words, when the game transits into the second game, three turned-back cards 223*a*, 223*b* and 223*c* are displayed first, as shown in FIG. 30A. And a notice "Please touch one of the three cards to select." is also displayed. Next, when the player touches a card 223*b* among the three cards 223*a*, 223*b* and 223*c*, the touched card is turned-up as shown in FIG. 30B. Then, the rescue pay (e.g., equivalent to 360 coins) described on the turned-up card is provided to the player. Here, 360, 200 and 100 credits are assigned to the three cards 223*a*, 223*b* and 223*c*, respectively. The location of each card is changed at random based on the random number generated by the RNG 112 for each of the second games.

Figure 28A:
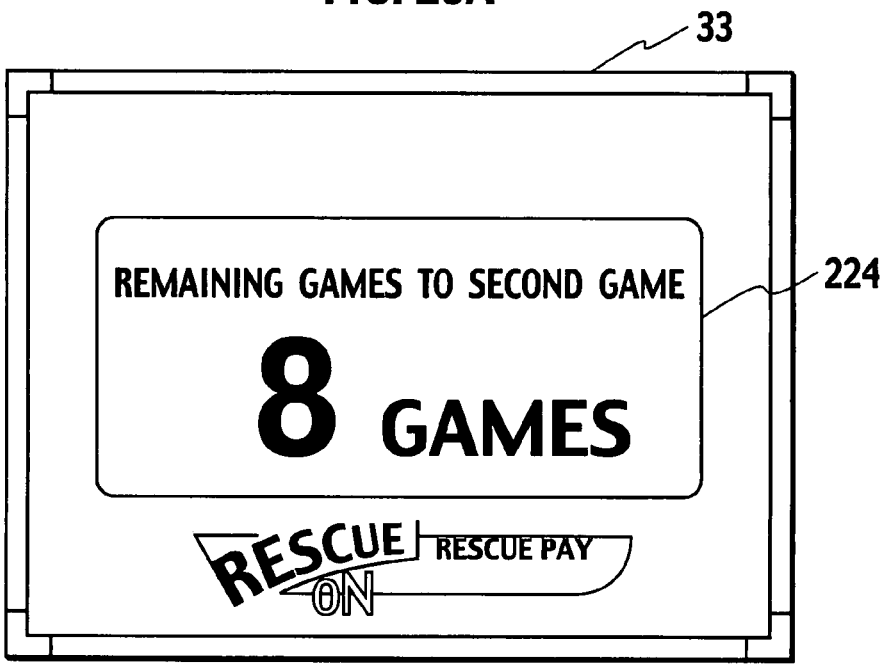
FIG. 28A is an exemplary display displayed on an LCD of the slot machine according to one embodiment of the present invention.
Figure 28B:
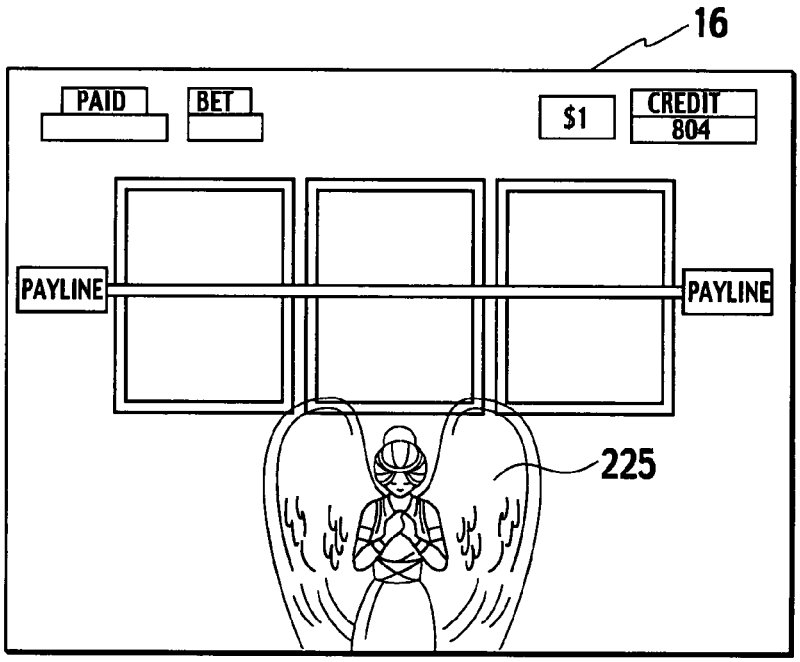
FIG. 28B is an exemplary display displayed on an LCD of the slot machine according to one embodiment of the present invention.

FIG. 28A is an exemplary display of an image displayed on the upper LCD 33 when the count-value Ta is approaching the upper limit Tamax. FIG. 28B is an exemplary display of an image displayed on the lower LCD 16. When the count-value Ta is "992", an image 224 is displayed on the upper LCD 33 in order to notify the player that eight games are left until a rescue pay is provided. In addition, an image 225 of an angel with folded wings is also displayed on the lower LCD 16.

Figure 29A:
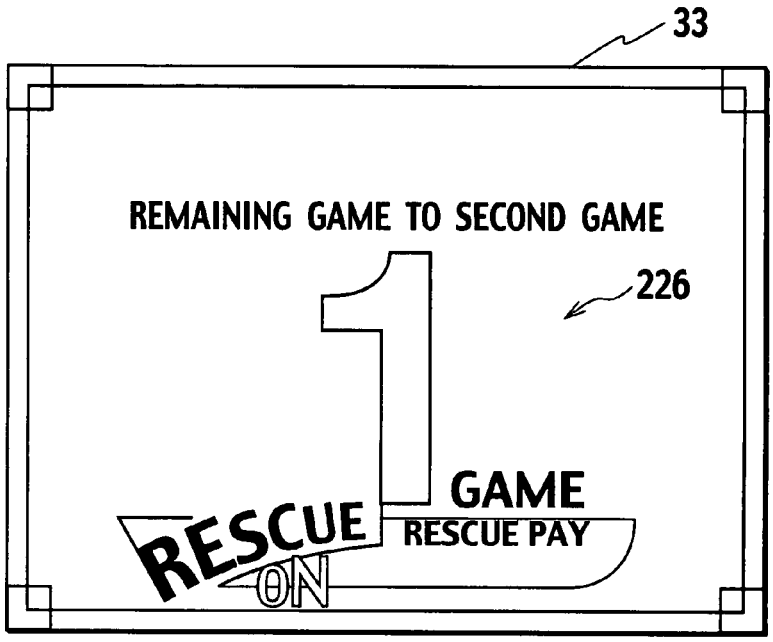
FIG. 29A is an exemplary display displayed on an LCD of the slot machine according to one embodiment of the present invention.
Figure 29B:
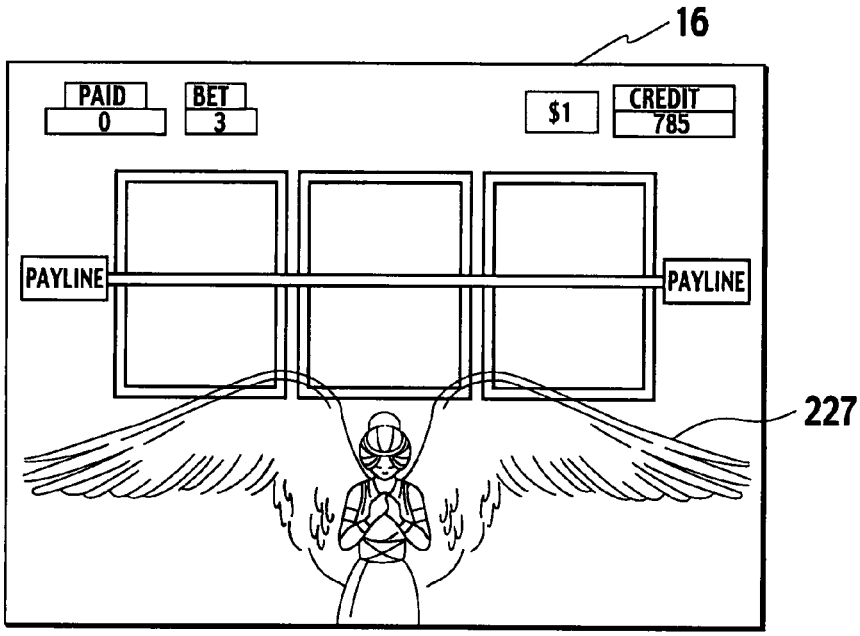
FIG. 29B is an exemplary display displayed on an LCD of the slot machine according to one embodiment of the present invention.

FIG. 29A is an exemplary display of an image displayed on the upper LCD 33 when the count-value Ta is "999". FIG. 29B is an exemplary display of an image displayed on the lower LCD 16. An image 226 is displayed on the upper LCD 33 in order to notify the player that one game is left until a progressive bonus (rescue pay) is provided. In addition, an image 227 of an angel with spread wings is also displayed on the lower LCD 16.

Figure 31A:
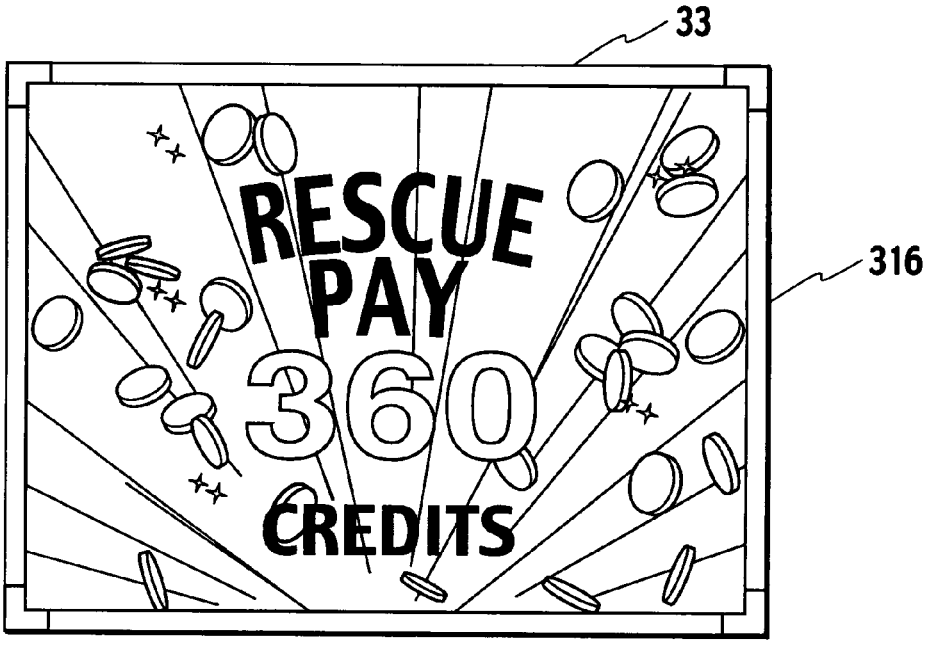
FIG. 31A is an exemplary display displayed on an LCD of the slot machine according to one embodiment of the present invention.
Figure 31B:
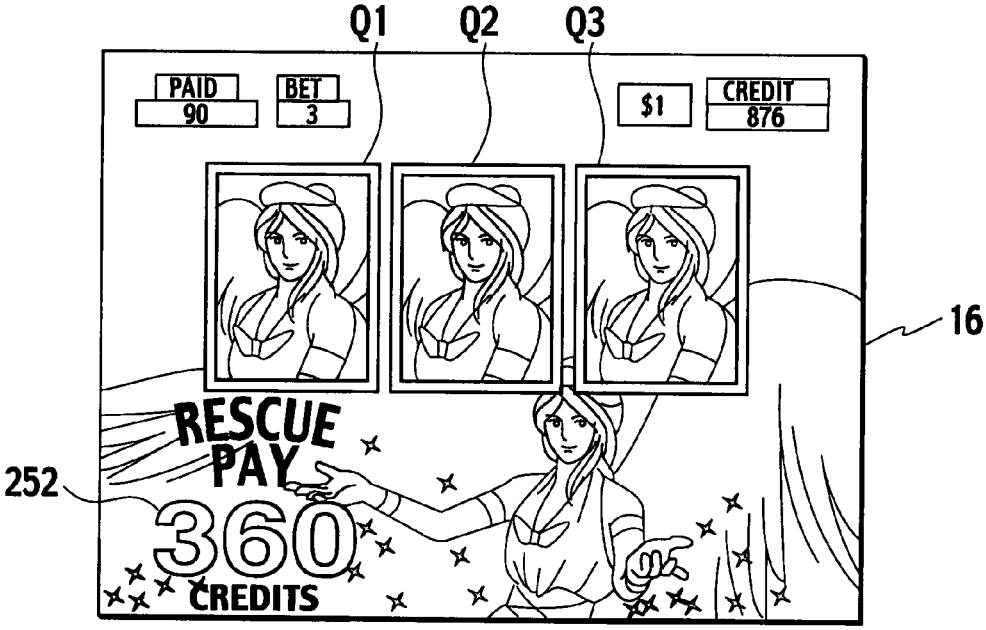
FIG. 31B is an exemplary display displayed on an LCD of the slot machine according to one embodiment of the present invention.

FIG. 31A is an exemplary display of an image displayed on the upper LCD 33 when the player selects one of the three cards in the second game after the count-value Ta has reached the upper limit Tamax="1000". FIG. 31B is an exemplary display of an image displayed on the lower LCD 16. Images 316 and 252 are displayed on the upper LCD 33 and the lower LCD 16 respectively in order to notify that a rescue pay (e.g., equivalent to 360 medals) is going to be provided according to the selected card.

Figure 32:
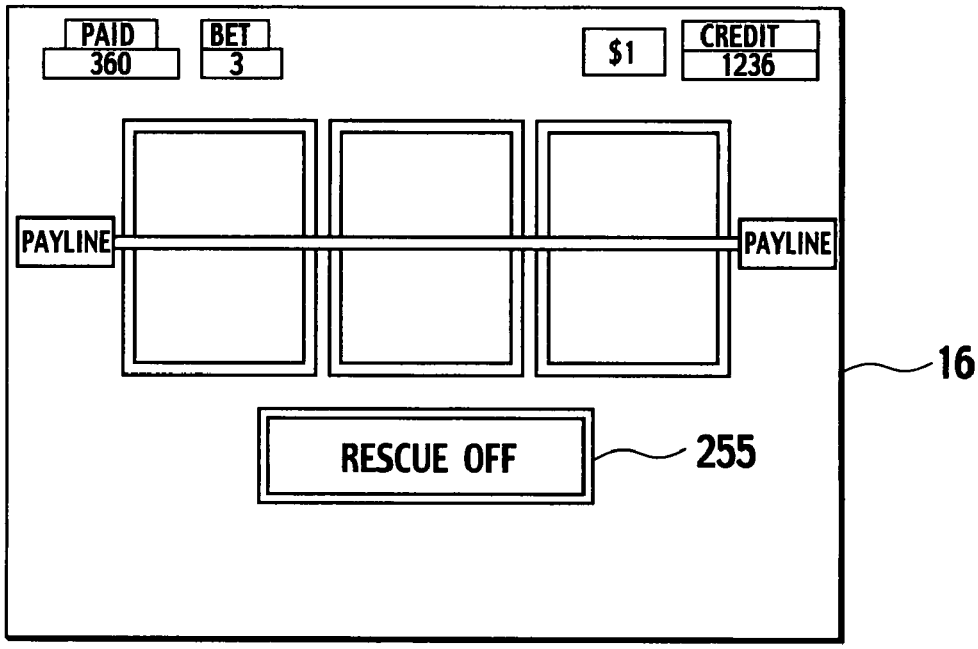
FIG. 32 is an exemplary display displayed on an LCD of the slot machine according to one embodiment of the present invention.

FIG. 32 is an example of an image displayed on the lower LCD 16 after the rescue pay has been provided. An image 255 is displayed on the lower LCD 16 in order to notify that the rescue pay is deactivated as a result of awarding the rescue pay.

Figure 8:
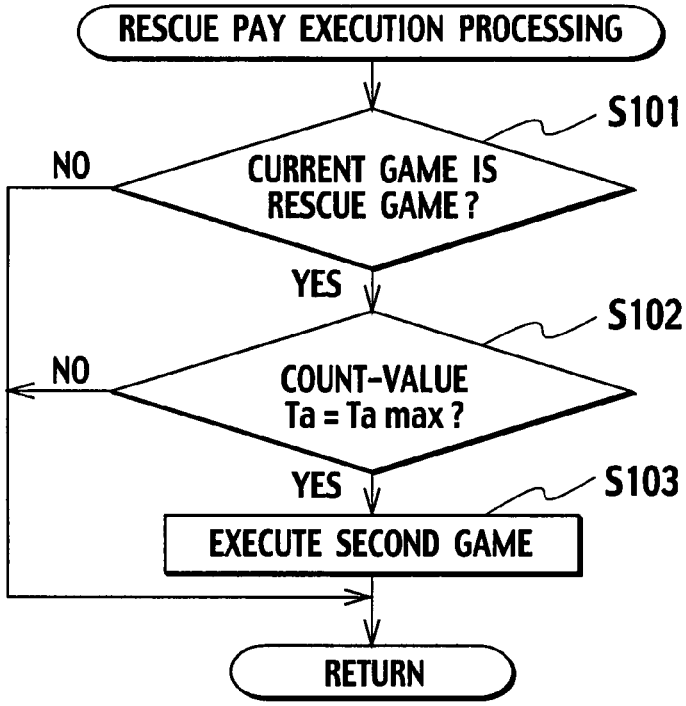
FIG. 8 is a flow chart illustrating the processing procedure according to one embodiment of the present invention.

In this manner, the second game shown in step S103 of FIG. 8 is executed.

Figure 9:
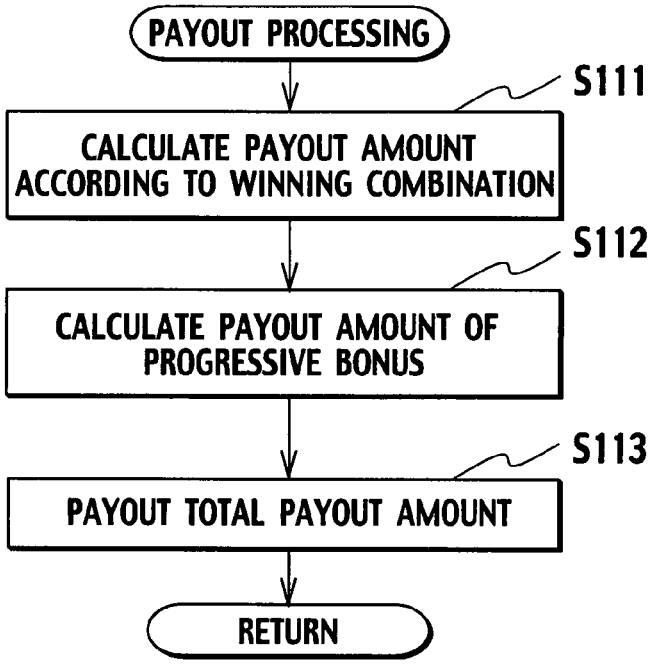
FIG. 9 is a flow chart illustrating the processing procedure according to one embodiment of the present invention.

Next, the payout processing shown in step S37 of FIG. 4 will be described in detail with reference to FIG. 9. First, the payout amount is calculated based on the winning combination (step S111). Specifically, the payout amount of step S74 of FIG. 6 is calculated. Subsequently, the processing proceeds to step S112.

Next, the payout amount according to the rescue pay is calculated (step S112). In other words, a payout amount according to the rescue pay is calculated when the rescue pay has been awarded in the second game execution processing of step S103 of FIG. 8. In the present embodiment, the payout amount equivalent to 360 medals is awarded. Subsequently, the processing proceeds to step S113.

The total payout amount is calculated according to the winning combination and the rescue pay, and then the payout according to the summed payout amount is cashed out from the cash-out opening 28 (see FIG. 2) with medals or coins (step S113). The payout may be provided by credits, in which case the credit counter of the slot machine is counted up. Subsequently, the processing is completed.

With the slot machine 10 of the present embodiment, as thus described, the game is transits into the second game when the count-value reaches the upper limit (predefined value) Tamax during the rescue games. And then the rescue pay is provided according to the outcome of the second game.

Figure 10:
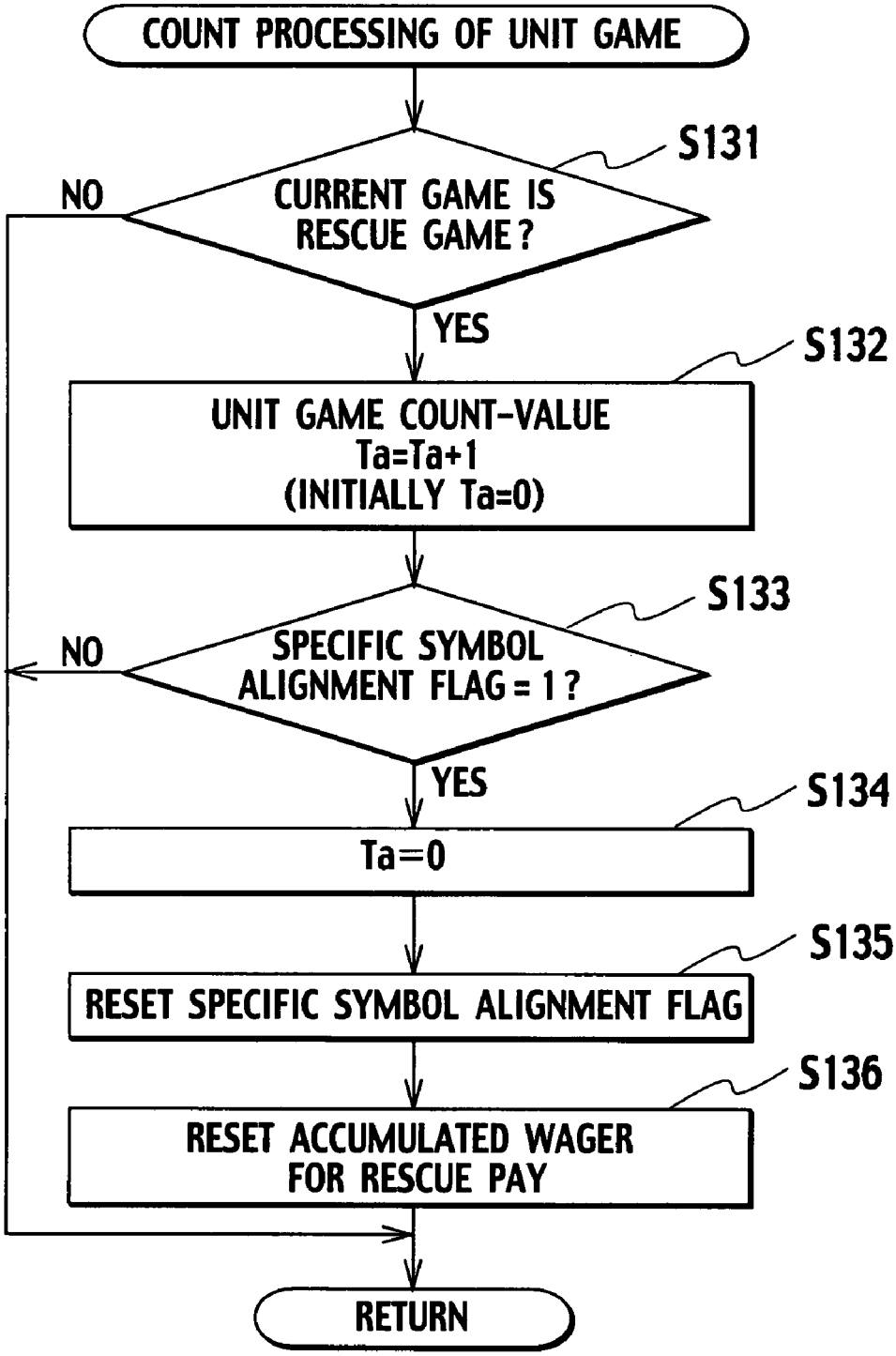
FIG. 10 is a flow chart illustrating the processing procedure according to one embodiment of the present invention.

Next, an exemplary modification of the above first embodiment will be described below. The present exemplary modification differs from the first embodiment only in the count processing of the unit game. The count processing of the unit game according to the exemplary modification will be described below with reference to the flow chart shown in FIG. 10.

First, it is determined whether or not the current unit game is a rescue game (step S131). If the current unit game is a rescue game (YES in step S131), the processing proceeds to step S132. Since the processing of steps S132 to S136 is similar to that of steps S91 to S95 of FIG. 7, detailed description of the processing procedure is omitted.

On the other hand, if the current unit game is not a rescue game (NO in step S131), the processing is completed without incrementing the count-value Ta. In other words, the count-value Ta is not incremented in the unit games, which are not the rescue game. The count-value Ta is incremented only in the unit games, which are the rescue game.

With the present exemplary modification, as thus described, the count-value Ta is incremented for each execution of the rescue game. The rescue pay is provided when the count-value Ta reaches the upper limit Tamax.

Figure 11:
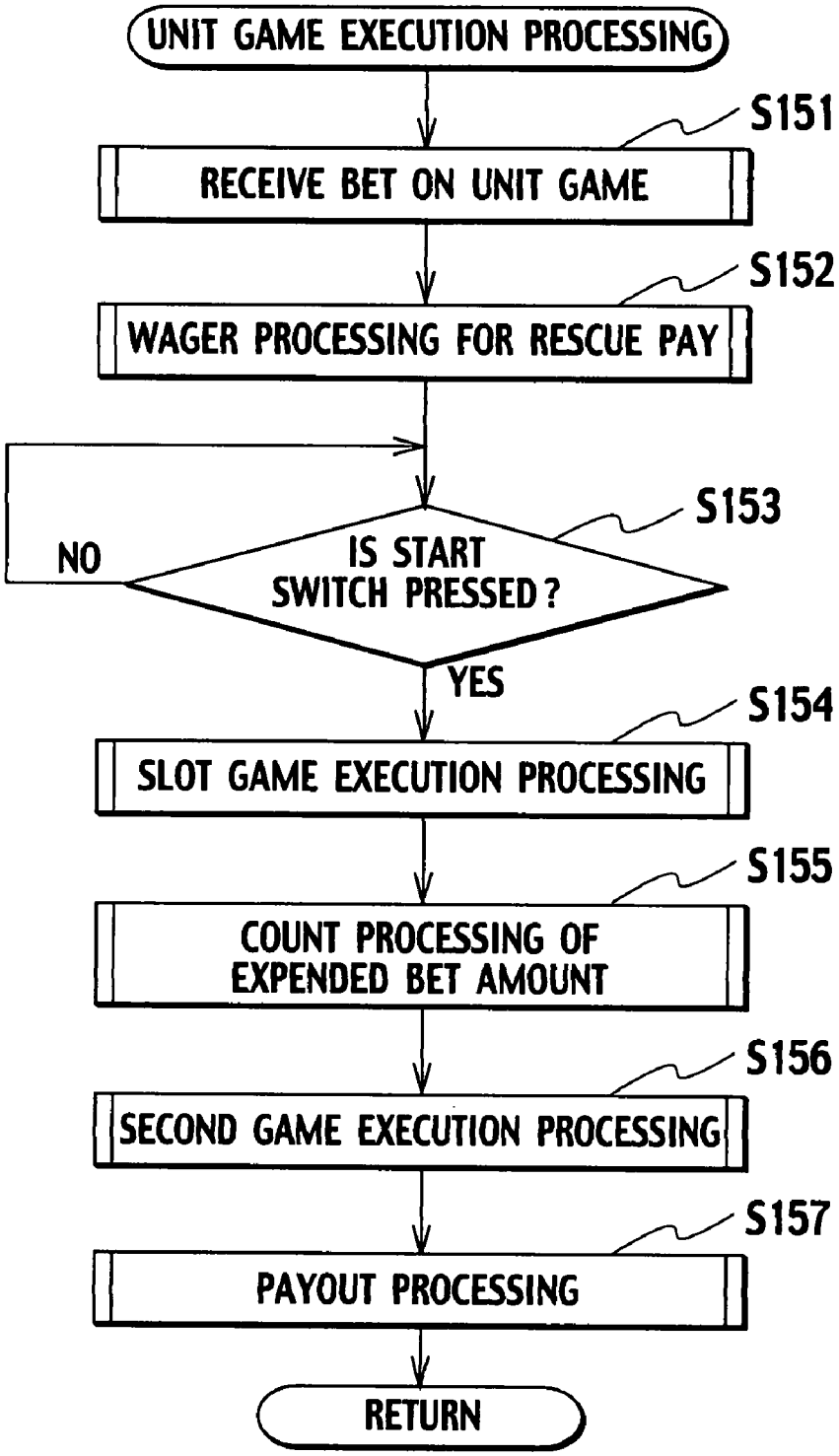
FIG. 11 is a flow chart illustrating the processing procedure according to one embodiment of the present invention.

Next, the second embodiment of the present invention will be described. FIG. 11 is a flow chart illustrating the processing procedure of the unit game executed on the slot machine (gaming machine) 10 according to the second embodiment. Comparing the unit game execution processing of FIG. 11 (the present embodiment) with the unit game execution processing of FIG. 4 (the first embodiment) steps S151 to S154 of FIG. 11 are identical to steps S31 to S34 of FIG. 4, and step S157 of FIG. 11 is identical to step S37 of FIG. 4. Steps S155 and S156 of FIG. 11 differ from steps S35 and S36 of FIG. 4.

Figure 12:
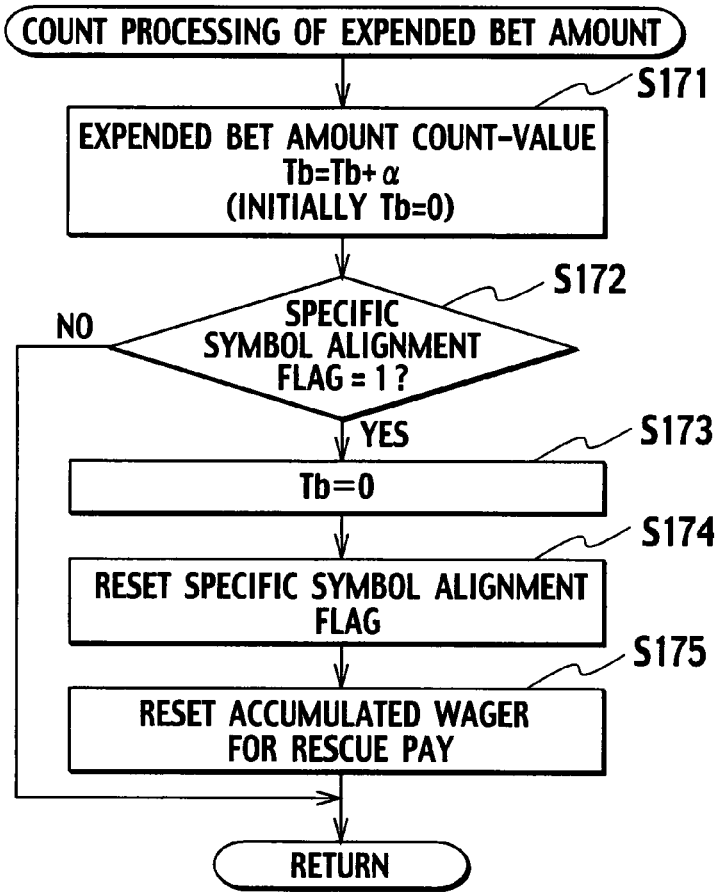
FIG. 12 is a flow chart illustrating the processing procedure according to one embodiment of the present invention.

In the following, the count processing of the expended bet amount of step S155 of FIG. 11 is described with reference to the flow chart shown in FIG. 12.

First, a newly placed bet amount $\alpha$ is added to the count-value Tb of the current expended bet amount (accumulation of the expended bet amount) [$Tb=Tb+\alpha$] (step S171). Here, the initial value (when the slot machine 10 is powered on) of the count-value Tb is zero. In addition, the count-value Tb is reset in step S173 described below. Note that the count-value Tb is an accumulated value of the bet amount (number of medals or credits) placed on successive unit games. If three medals are bet on a unit game, for example, it results in $\alpha=3$ and a count-value of $Tb=Tb+3$. Upon completion of step S171, the processing proceeds to step S172.

Next, it is determined whether or not the specific symbol alignment flag is "1" (step S172). In other words, it is determined whether or not the specific symbol alignment flag of step S76 of FIG. 6 is "1". If the specific symbol alignment flag is "1" (YES in step S172), the count-value Tb is reset (step S173).

Furthermore, the specific symbol alignment flag is also reset (step S174). Then, the wager for the rescue pay is also reset (step S175). In other words, if a payout of ×60 or higher is awarded, both the count-value Tb of the expended bet amount and the wager for the rescue pay in step S152 of FIG. 11 are reset.

On the other hand, if it is determined that the specific symbol alignment flag is not "1" (NO in step 172), the processing is completed. In other words, if the specific symbol alignment flag is not "1" (NO in step 172), the processing is completed and proceeds to the next unit game after the count-value Tb is counted (accumulated).

In the above-mentioned count processing, if a winning combination with a ×60 or higher payout is not awarded (specific symbols are not aligned), a newly placed bet amount $\alpha$ (e.g., $\alpha=3$) is added to the count-value Tb. In this manner, the expended bet amount during successive unit games in which any specific symbols have not been aligned is counted. Additionally, if a winning combination with a ×60 or higher payout is awarded (specific symbols are in alignment), the count-value Tb is reset.

Figure 13:
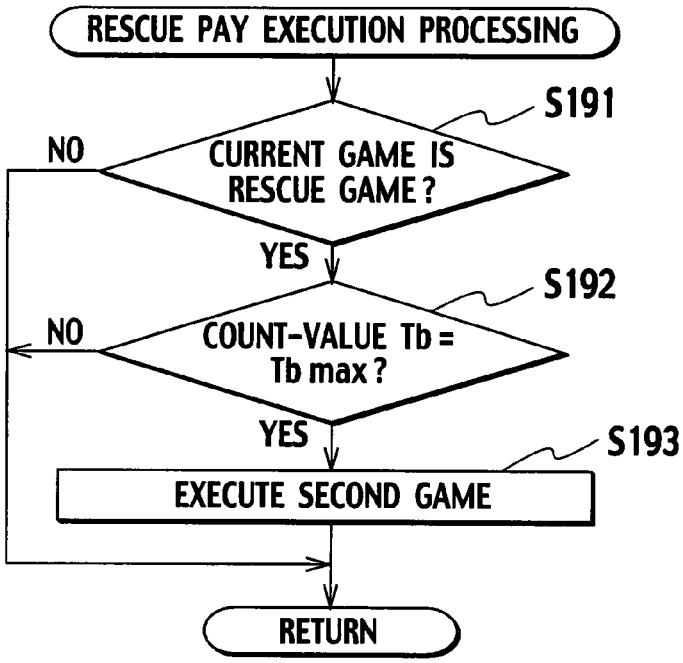
FIG. 13 is a flow chart illustrating the processing procedure according to one embodiment of the present invention.

Next, the second game execution processing of step S156 of FIG. 11 will be described with reference to the flow chart shown in FIG. 13. First, it is determined whether or not the current unit game is a rescue game (step S191). If the current unit game is a rescue game (YES in step S191), the processing proceeds to step S192. On the other hand, if the current unit game is not a rescue game (NO in step S191), the processing is completed.

If the determination of step S191 is affirmative, it is determined whether or not the count-value Tb of the expended bet amount is equal to a preset upper limit Tbmax (e.g., Tbmax=3000) (step S192). Then, if Tb=Tbmax (YES in step S192), the processing proceeds to step S193. On the other hand, if not Tb=Tbmax (NO in step S192), the processing is completed.

If the determination of step S192 is affirmative, the second game execution processing is executed (step S193). In other words, if the specific symbols have not been aligned although the expended bet amount reaches the upper limit Tbmax, the second game execution processing is executed. Here, "the specific symbols are not aligned" means that a winning combination with a ×60 or higher payout is not awarded, specifically.

With the second embodiment of the present invention, as thus described, the game transits into the second game and then the rescue pay is awarded to the player when the count-value Tb (accumulation of the expended bet amount) reaches the upper limit Tbmax during the rescue games.

Furthermore, since the rescue game can be set every prescribed numbers of the unit games (10 unit games in the present embodiment), the rescue games can be set according to the player's preference.

Figure 14:
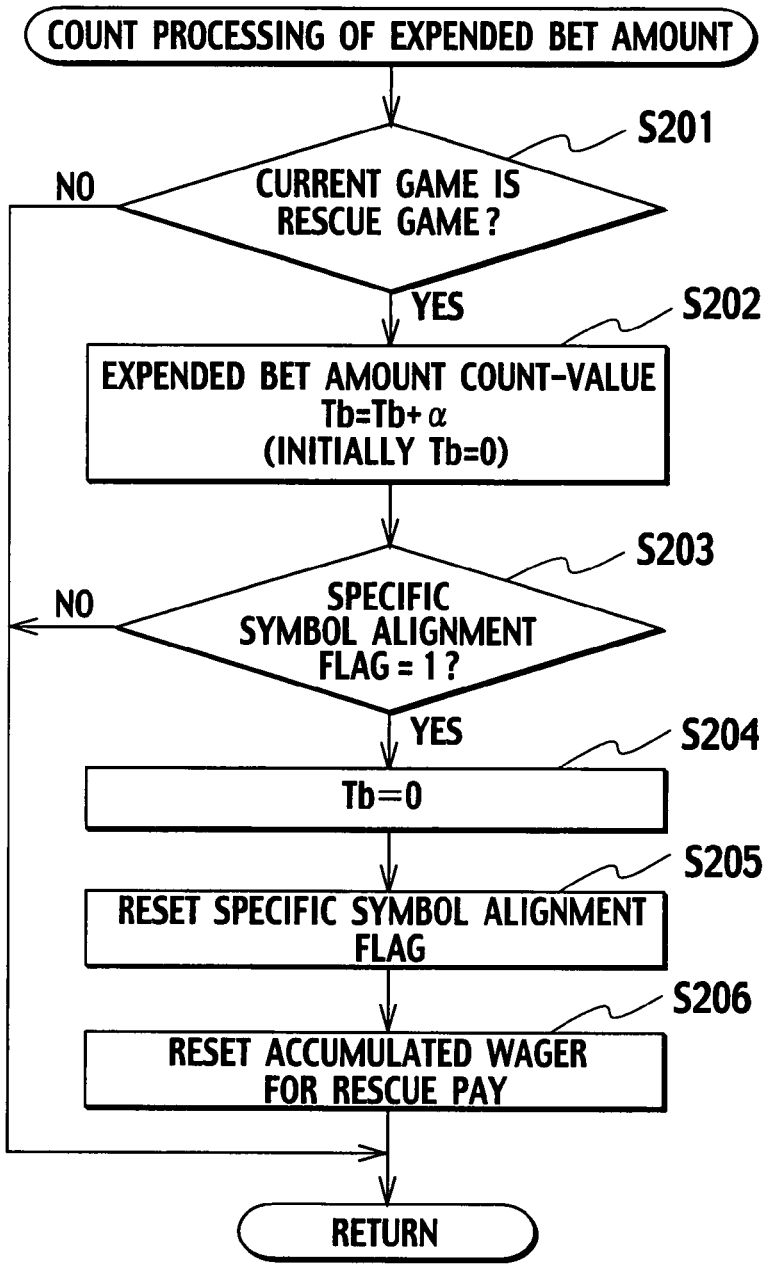
FIG. 14 is a flow chart illustrating the processing procedure according to one embodiment of the present invention.

Next, an exemplary modification of the second embodiment will be described with reference to the flow chart shown in FIG. 14. The exemplary modification differs from the above second embodiment only in the count processing of the expended bet amount. In the following, the count processing of the expended bet amount of the exemplary modification will be described with reference to the flow chart shown in FIG. 14.

First, it is determined whether or not the current unit game is a rescue game (step S201). If the current unit game is a rescue game (YES in step S201), the processing proceeds to step S202. Since the processing of steps S202 to S206 is similar to that of steps S171 to S175 of FIG. 12, detailed description of the processing procedure is omitted.

On the other hand, if the current unit game is not a rescue game (NO in step S201), the processing is completed without counting the count-value Tb (without adding a newly placed bet amount $\alpha$). In other words, the count-value Tb is not counted (accumulated) in the unit games, which are not the rescue game. The count-value Tb is counted (accumulated) only in the unit games, which are the rescue game.

With such an exemplary modification, the count-value Tb is counted (accumulated) at each wager in the rescue games. The rescue pay is provided when the count-value Tb reaches the upper limit Tbmax.

Additionally, with the second embodiment and its exemplary modification, a newly placed bet amount $\alpha$ on the unit game is added to the count-value Tb. However, it may be arranged such that a difference between a bet amount on a unit game and a payout amount for the unit game is added to the count-value Tb. For example, a wager of total 30 medals has been bet during 10 unit games and a payout of total 10 medals is awarded during the 10 unit games. And then, the difference between the bet amount and the payout amount (=20 medals) may be added to the count-value Tb. In other words, the count-value Tb is accumulated according to the player's substantial loss. In other words, a shown in step S171 of FIG. 12 or S202 of FIG. 14 is a difference between a newly placed bet amount on a new unit game and a payout amount for the new unit game. The new difference $\alpha$ (=difference between the bet amount on the new unit game and the payout amount for the new unit game) is added to the current count-value Tb of the accumulated difference [$Tb=Tb+\alpha$].

Additionally, the above-mentioned first embodiment is an example wherein the game transits into the second game when the count-value Ta of the number of the executed unit games reaches the upper limit Tamax, and the rescue pay is awarded according to the outcome of the second game. Also, the above-mentioned second embodiment is an example wherein the game transits into the second game when the count-value Tb of the expended bet amount during successive unit games reaches the upper limit Tbmax, and the rescue pay is awarded according to the outcome of the second game. It may be arranged such that the rescue pay is awarded using the combination of these.

In other words, the game transits into the second game if either one of the following cases is achieved: when the count-value Ta reaches the upper limit Tamax; or when the count-value Tb reaches the upper limit Tbmax. And then, the rescue pay is awarded according to the outcome of the second game.

Next, the processing procedure according to the third embodiment for executing the unit game on the above-mentioned slot machine 10 will be described. The unit game execution processing of the present embodiment is generally similar to that of the first embodiment. However, the count processing of the unit game and the second game execution processing of the present embodiment differ from those of the first embodiment (steps S35 and S36 in FIG. 4). Other processings of the present embodiment are identical to those of the first embodiment (steps S31 to S34 and S37). Therefore, the count processing of the unit game and the second game execution processing of the third embodiment is described below with reference to the flow charts shown in FIGS. 15 and 16.

Figure 15:
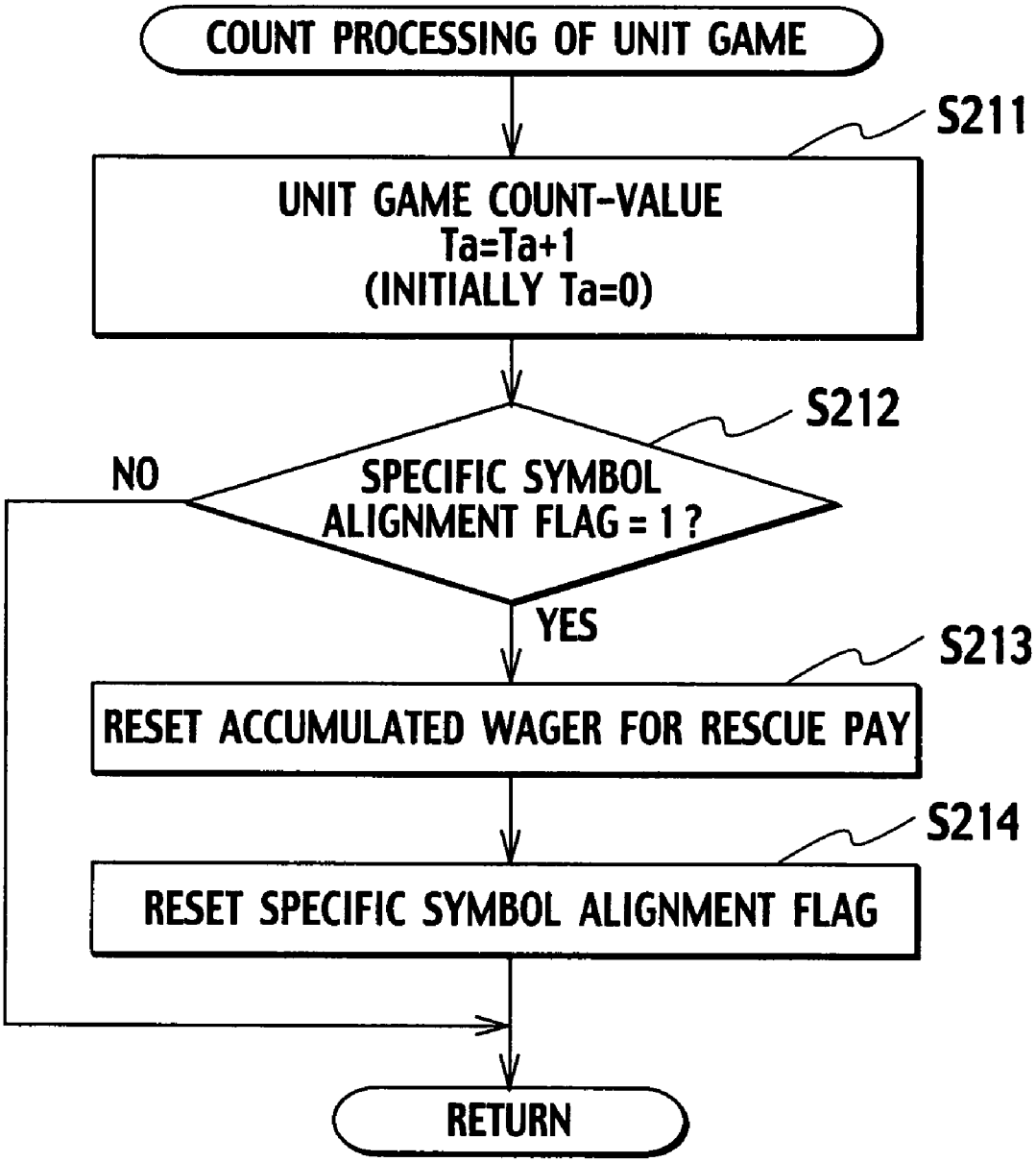
FIG. 15 is a flow chart illustrating the processing procedure according to one embodiment of the present invention.

In the count processing of the unit game shown in FIG. 15, the count-value Ta of the unit game is incremented [Ta=Ta+1] (step S211) at first. Note that the count-value Ta is a value for counting the number of executed unit games. The initial value of the count-value Ta is zero. Upon completion of step S211, the processing proceeds to step S212.

Next, it is determined whether or not the specific symbol alignment flag is "1" (step S212). If the specific symbol alignment flag is "1" (YES in step S212), the wager for the rescue pay is reset (step S213). Furthermore, the specific symbol alignment flag is also reset (step S214). In other words, if a payout of ×60 or higher is awarded (that is, if the specific symbol alignment flag is "1") (YES in step S212), the wager for the rescue pay in step S32 of FIG. 4 is reset. It is the different point from the first embodiment that the count-value Ta is not reset.

On the other hand, if it is determined that the specific symbol alignment flag is not "1" (NO in step 212), the processing is completed. In other words, if the specific symbol alignment flag is not "1" (NO in step S212), the processing is completed and proceeds to the next unit game after the count-value Ta is incremented.

Figure 16:
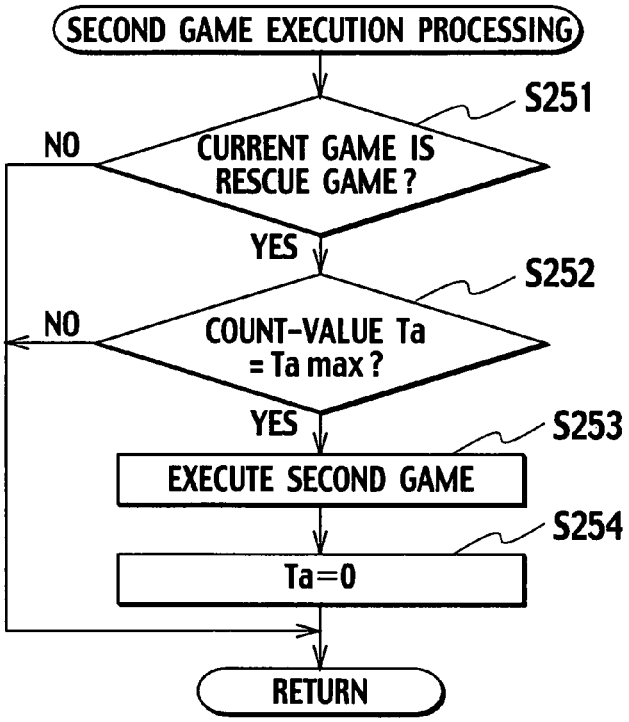
FIG. 16 is a flow chart illustrating the processing procedure according to one embodiment of the present invention.

Next, the second game execution processing of the third embodiment will be described with reference to the flow chart shown in FIG. 16. First, it is determined whether or not the current unit game is a rescue game (step S251). If the current unit game is a rescue game (YES in step S251), the processing proceeds to step S252. On the other hand, if the current unit game is not a rescue game (NO in step S251), the processing is completed.

If the determination of step S251 is affirmative, it is determined whether or not the count-value Ta is equal to a preset upper limit Tamax (e.g., Tamax=1000) (step S252). Then, if Ta=Tamax (YES in step S252), the processing proceeds to step S253. On the other hand, if not Ta=Tamax (NO in step S252), the processing is completed.

If the determination of step S252 is affirmative, a second game is executed (step S253). In other words, if the specific symbols have not been aligned although the number of executed games (=the count-value Ta) reaches the upper limit Tamax, a second game is executed. Here, "the specific symbols are not aligned" means that a winning combination with a ×60 or higher payout is not awarded, specifically. Then, the processing proceeds to step S254. The count-value Ta is reset (step S254).

In the slot machine (gaming machine) 10 of the third embodiment, if a winning combination with a ×60 or higher payout is awarded (that is, if the specific symbol alignment flag is "1"), the wager for the rescue pay is reset. However, the count-value Ta is not reset at this point. The count-value Ta is reset when the rescue pay is awarded according to the outcome of the second game (step S254 in FIG. 16).

Therefore, the count-value Ta is not reset in case that the specific symbol alignment flag turns to "1" before the count-value reaches the upper limit Tamax. Thus, if the player places a new wager for a rescue pay again, a second game will be executed when the count-value Ta comes to reach the upper limit Tamax.

In the slot machine (gaming machine) 10 of the third embodiment, as described above, the count-value Ta is not reset until a rescue pay is provided.

Figure 17:
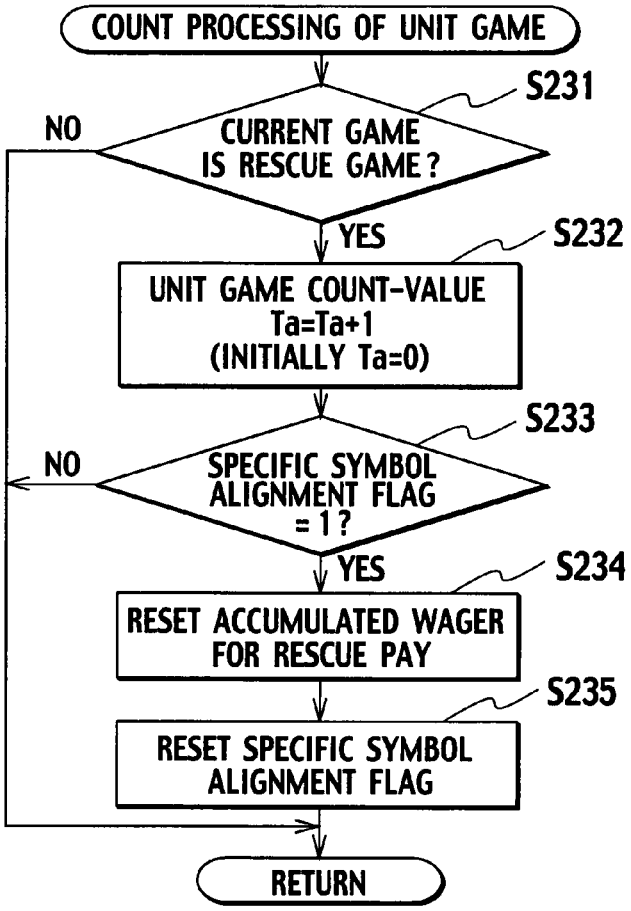
FIG. 17 is a flow chart illustrating the processing procedure according to one embodiment of the present invention.

Next, an exemplary modification of the third embodiment will be described. FIG. 17 shows the flow chart of processing of the unit game of the present exemplary modification.

First, it is determined whether or not the current unit game is a rescue game (step S231). If the current unit game is a rescue game (YES in step S231), the processing proceeds to step S232. Since the processing of steps S232 to S235 is similar to that of steps S211 to S214 of FIG. 15, detailed description of the processing procedure is omitted.

On the other hand, if the current unit game is not a rescue game (NO in step S231), the processing is completed without incrementing the count-value Ta. In other words, the count-value Ta is not incremented in the unit games, which are not the rescue game. The count-value Ta is incremented only in the unit games, which are the rescue game.

With the present exemplary modification, the count-value Ta is incremented only in the unit games, which are the rescue game.

Figure 18:
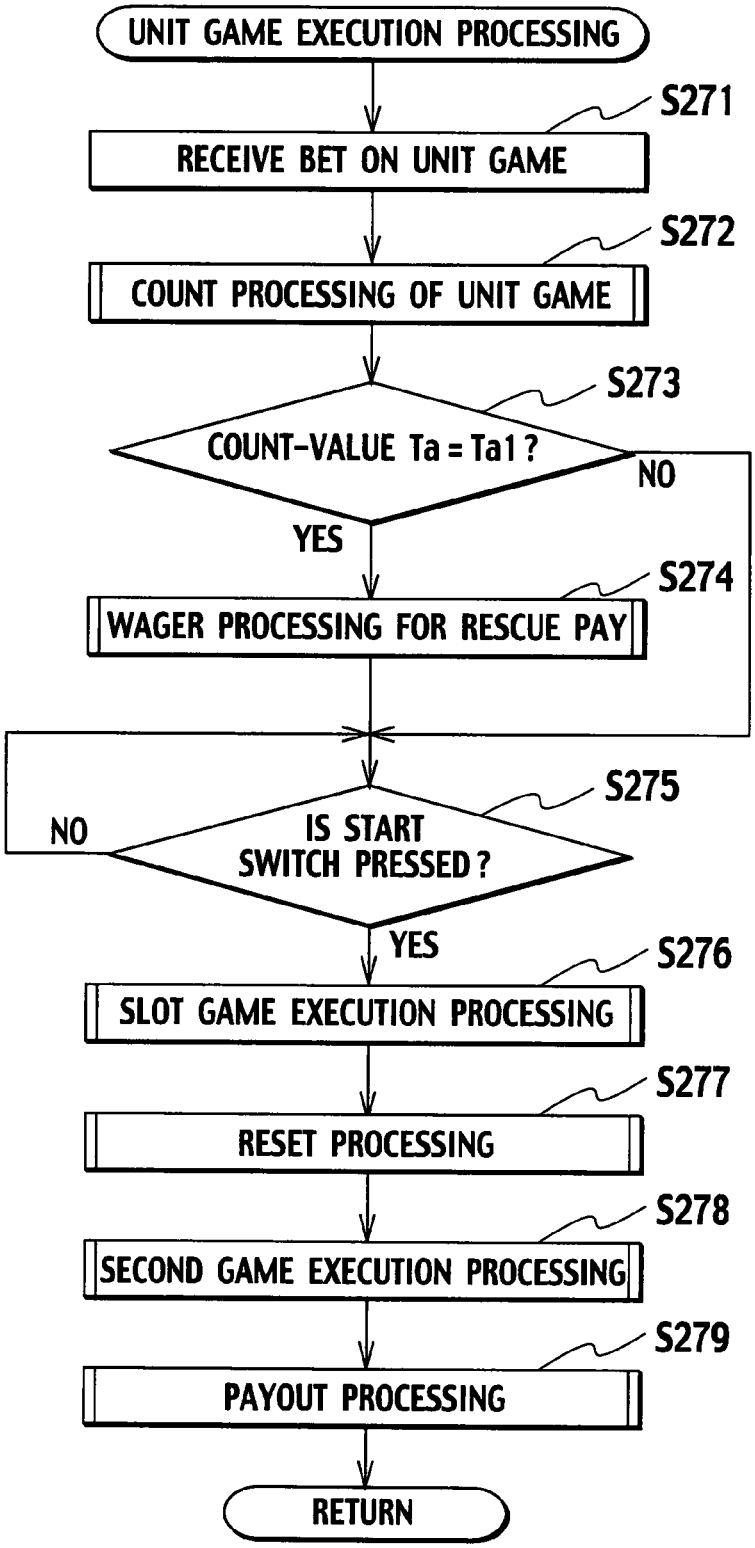
FIG. 18 is a flow chart illustrating the processing procedure according to one embodiment of the present invention.

Next, a slot machine (gaming machine) 10 of the fourth embodiment will be described. FIG. 18 shows the flow chart of the unit game execution processing of the fourth embodiment. After starting a unit game, a bet on the unit game is firstly received (step S271). Specifically, the insertion of the medal(s) into the medal insertion slot 21 or the pressing-down of the bet switches 24, 25 is detected by the CPU 106.

Next, a count processing of the unit game is executed (step S272). The count processing of the unit game will be described below, referring to the flow chart shown in FIG. 19. Subsequently, it is determined whether or not the count-value Ta reaches a preset criterion value Ta1 (e.g., Ta1=100) (step S273). Then, if the count-value Ta reaches the criterion value Ta1 (YES in step S273), the processing proceeds to step S274. On the other hand, if the count-value Ta does not reach the criterion value Ta1 (NO in step S273), the processing proceeds to step S275.

If the determination of step S273 is affirmative, a wager processing for the rescue pay is executed (step S274). Here, the wager for the rescue pay is received via the touch-screen 19 on the lower LCD 16. In other words, the wager for the rescue pay can be placed only when the count-value Ta has reached the criterion value Ta1. Since the wager processing for the rescue pay is identical to the processing shown in FIG. 5, detailed description of the processing procedure is omitted.

Subsequently, it is determined whether or not the start switch 27 is pressed (step S275). If the start switch 27 is pressed, the processing proceeds to step S276.

Next, a slot game execution processing is executed (step S276). Here, a processing of rearranging the symbols having been arranged on respective three display areas Q1 to Q3 is executed. Since the slot game execution processing is identical to the processing shown in FIG. 6, detailed description of the processing procedure is omitted.

Next, a reset processing is executed (step S277). The details will be described below, referring to the flow chart of FIG. 20.

Next, a second game execution processing is executed (step S278).

Next, a payout processing is executed (step S279). In this processing, if a winning combination is formed by the rearranged symbols on the three display areas Q1 to Q3, or if the progressive bonus is awarded, a payout is provided (as medals or credits) to the player. Subsequently, the processing proceeds to the next unit game.

Figure 19:
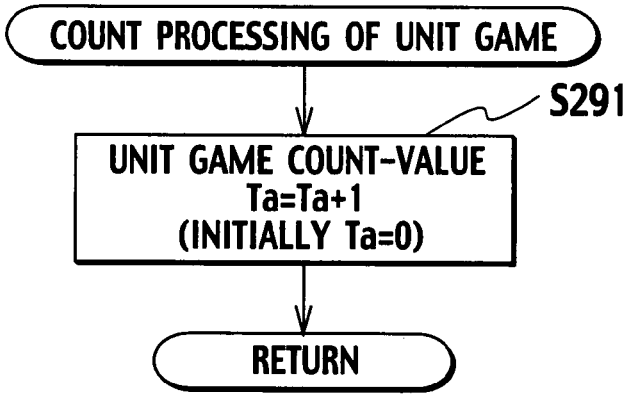
FIG. 19 is a flow chart illustrating the processing procedure according to one embodiment of the present invention.

Next, the count processing of the unit game of step S272 of FIG. 18 will be described with reference to the flow chart shown in FIG. 19. Here, the count-value Ta of the unit game is incremented [Ta=Ta+1] (step S291). Subsequently, the processing is completed.

Figure 20:
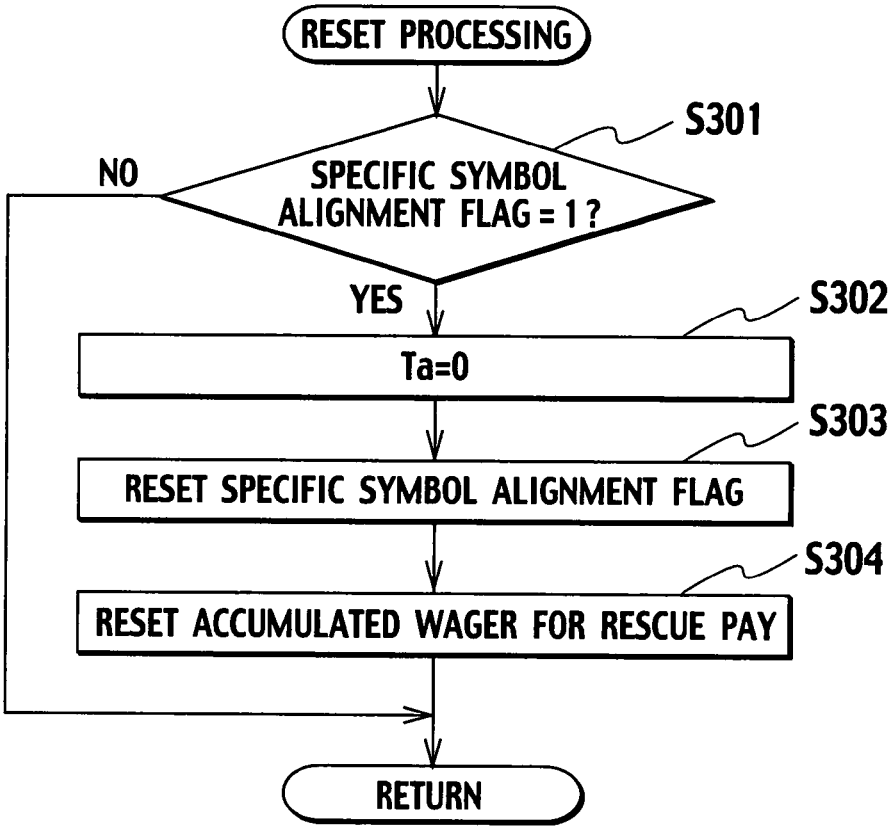
FIG. 20 is a flow chart illustrating the processing procedure according to one embodiment of the present invention.

Next, the reset processing of step S277 of FIG. 18 will be described with reference to the flow chart shown in FIG. 20. First, it is determined whether or not the specific symbol alignment flag is "1" (step S301). If the specific symbol alignment flag is "1" (YES in step S301), the count-value Ta is reset (step S302). Furthermore, the specific symbol alignment flag is also reset (step S303). Then, the wager for the rescue pay is also reset (step S304).

In other words, if the specific symbol alignment flag is "1" (that is, if a ×60 or higher payout is awarded) (YES in step S301), both the count-value Ta of the unit game and the wager for the rescue pay in step S274 of FIG. 18 are reset.

On the other hand, if the specific symbol alignment flag is not "1" (NO in step S301), the processing is completed. In other words, if the specific symbol alignment flag is not "1" (NO in step S301), the processing is completed and proceeds to the next unit game without resetting the count-value Ta, the specific symbol alignment flag, and the wager for the rescue pay.

In the slot machine (gaming machine) 10 of the fourth embodiment, as described above, the wager for the rescue pay can be placed only when the count-value Ta of the number of the executed unit games has reached the criterion value Ta1.

Figure 23:
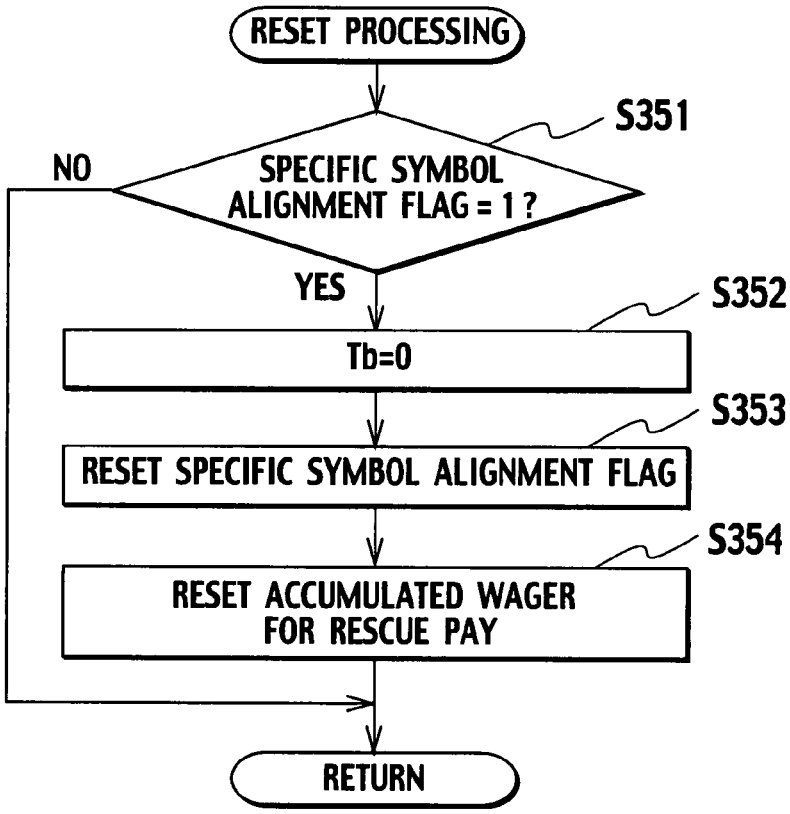
FIG. 23 is a flow chart illustrating the processing procedure according to one embodiment of the present invention.

Next, the slot machine (gaming machine) 10 of the fifth embodiment will be described. FIG. 23 is a flow chart illustrating the procedure of the unit game execution processing according to the fifth embodiment. After starting a unit game, a bet on the unit game is received (step S311). Specifically, the insertion of the medal(s) into the medal insertion slot 21 or the pressing-down of the bet switches 24, 25 is detected by the CPU 106.

Next, a count processing of the expended bet amount is executed (step S312). The count processing of the expended bet amount will be described referring to the flow chart of FIG. 22. Subsequently, it is determined whether or not the count-value Tb, which is counted in the count processing of the expended bet amount of step S312, reaches a preset criterion value Tb1 (e.g., Tb1=300) (step S313). Then, if the count-value Tb reaches the criterion value Tb1 (YES in step S313), the processing proceeds to step S314. On the other hand, the count-value Tb does not reach the criterion value Tb1 (NO in step S313), the processing proceeds to step S315.

If the determination of step S313 is affirmative, a wager processing for the rescue pay is executed (step S314). Here, the wager for the rescue pay is received via the touch-screen 19 on the lower LCD 16. In other words, the wager for the rescue pay can be placed only when the count-value Tb has reached the criterion value Tb1. Since the wager processing for the rescue pay is identical to the processing shown in FIG. 5, detailed description of the processing procedure is omitted.

Subsequently, it is determined whether or not the start switch 27 is pressed (step S315). If the start switch 27 is pressed, the processing proceeds to step S316.

Next, a slot game execution processing is executed (step S316). Since the slot game execution processing is identical to the processing shown in FIG. 6, detailed description of the processing procedure is omitted.

Next, a reset processing is executed (step S317). The details will be described below, referring to the flow chart of FIG. 23.

Next, a second game execution processing is executed (step S318). In this processing, if a payout equal to or larger than a specified amount (e.g., corresponding to 60 or more medals per one medal) is not provided during a predefined number of executed unit games, a second game is executed and a rescue pay is provided to the player according to the outcome of the second game. Since the second game execution processing is identical to the processing shown in FIG. 8, detailed description of the processing procedure is omitted.

Next, a payout processing is executed (step S319). In this processing, if a winning combination is formed by the rearranged symbols on the three display areas Q1 to Q3, or if the rescue pay is awarded, a payout is provided (as medals or credits) to the player. Subsequently, the processing proceeds to the next unit game.

Next, the count processing of the expended bet amount of step S312 of FIG. 21 will be described with reference to the flow chart shown in FIG. 22. Here, a newly placed bet amount a is added to the count-value Tb of the current expended bet amount [Tb=Tb+α] (step S331). Subsequently, the processing is completed.

As mentioned above, a newly placed bet amount α on the unit game is added to the count-value Tb. However, it may be arranged such that a difference between a wager amount on a unit game and a payout amount for the unit game is added to the count-value Tb. In this case, the count-value Tb is accumulated according to the player's substantial loss. In other words, a shown in step S331 of FIG. 22 is a difference between a newly placed bet amount on a new unit game and a payout amount for the new unit game. The new difference a (=difference between the bet amount on the new unit game and the payout amount for the new unit game) is added to the current count-value Tb of the accumulated difference [Tb=Tb+α].

Next, the reset processing of step S317 of FIG. 21 will be described with reference to the flow chart shown in FIG. 23. First, it is determined whether or not the specific symbol alignment flag is "1" (step S351). If the specific symbol alignment flag is "1" (YES in step S351), the count-value Tb is reset (step S352). Furthermore, the specific symbol alignment flag is also reset (step S353). Then, the wager for the rescue pay is also reset (step S354).

Figure 21:
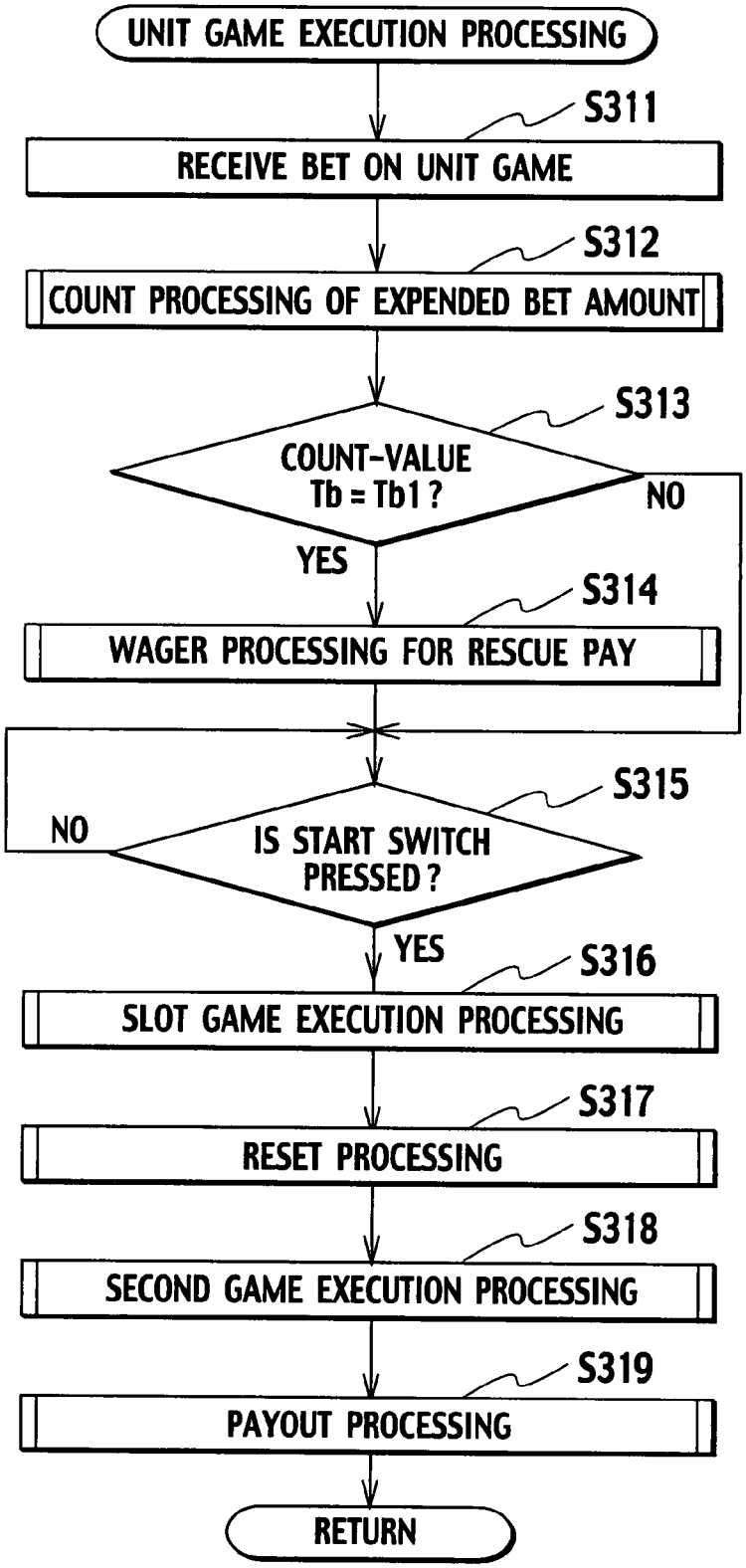
FIG. 21 is a flow chart illustrating the processing procedure according to one embodiment of the present invention.
Figure 22:
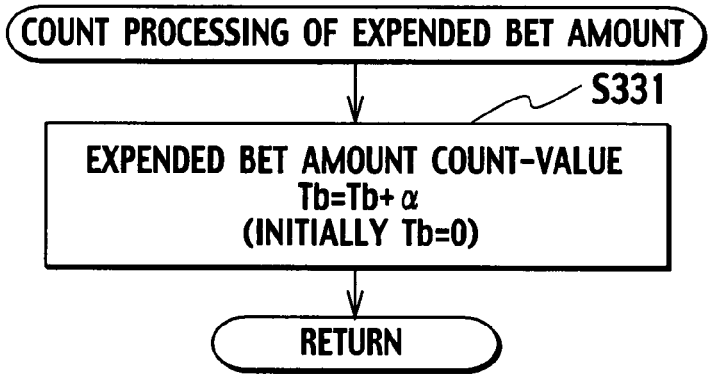
FIG. 22 is a flow chart illustrating the processing procedure according to one embodiment of the present invention.

In other words, if the specific symbol alignment flag is "1" (that is, if a payout of ×60 or higher is awarded) (YES in step S351), both the count-value Tb of the expended bet amount and the wager for the rescue pay in step S314 of FIG. 21 are reset.

On the other hand, if the specific symbol alignment flag is not "1" (NO in step 351), the processing is completed. In other words, if the specific symbol alignment flag is not "1" (NO in step S351), the processing is completed and proceeds to the next unit game without resetting the count-value Tb, the specific symbol alignment flag, and the wager for the rescue pay.

In the slot machine (gaming machine) 10 of the fifth embodiment, as described above, the wager for the rescue pay can be placed only when the count-value Tb of the expended bet amount has reached the criterion value Tb1.

The gaming machine and playing method of the present invention have been described above, based on the illustrated embodiments. However, the present invention is not limited to the stated embodiments. The arrangement of respective components may be replaced by any components having similar functionalities.

For example, in the above-mentioned embodiment, three display areas Q1 to Q3 are provided on the lower LCD 16, and the slot game is executed on respective display areas Q1 to Q3. However, the present invention, which is not limited to this arrangement, can be applied to various display areas such as a three-row×five-column display area.

Additionally, with the above-mentioned embodiment, the player is supposed to select any of the options by touching the touch-screen 19. However, any of the options may be selected by a switch without using the touch-screen 19.

Furthermore, with the slot machine 10 described in the present embodiment, the slot game is executed by displaying symbol images on the lower LCD 16. However, the present invention, which is not limited to this arrangement, may execute the slot game by turning a drum having a plurality of symbols on its periphery.

Additionally, with the present invention, a slot machine 10 has been described as an example of the gaming machine. However, the present invention, which is not limited to this, can be applied to other gaming machines such as a horse race game, for example.

Although embodiments of the present invention have been described above, they merely present specific examples and by no means limit the present invention particularly. Specific implementation of the arrangements can be modified in design as appropriate. In addition, the effects set forth in the embodiments of the present invention are merely an enumeration of the most preferred effects resulting from the present invention. The effects of the present invention are by no means limited to those set forth in the embodiments of the present invention.

Also, in the above detailed description, mainly characteristic portions have been set forth so that the present invention can be understood more easily. The present invention is not limited to the embodiments set forth in the above detailed description and can be applied to other embodiments, with a wide range of applications. In addition, terms and wordings used in the present specification are used to precisely describe the present invention and are not intended to limit the interpretation of the present invention. Also, those skilled in the art will easily conceive, from the concept of the invention set forth in the present specification, other arrangements, systems or methods included in the concept of the present invention. Therefore, it should be appreciated that the scope of the claims includes equivalent arrangements without deviating from the scope of technical ideas of the present invention. In addition, the purpose of the abstract is to facilitate the Patent Office and general public institutions, or engineers in the technological field who are not familiar with patent and legal terms or specific terms to quickly evaluate technical contents and the essence of this application by simple investigation. Therefore, the abstract is not intended to limit the scope of the invention, which should be evaluated by descriptions of the scope of the claims. Furthermore, it is desirable to take into consideration the already disclosed literatures sufficiently in order to completely understand the objects and specific effects of the present invention.

The above detailed description includes processes executed by a computer. The aforementioned descriptions and expressions are described with a purpose that those skilled in the art will understand them most efficiently. In the present specification, each step used for deriving one result should be understood as a self-consistent process. Also, transmission, reception and recording of electric or magnetic signals are executed in each step. In the processes in respective steps, although such signals are expressed as bits, values, symbols, characters, terms or numerals, it should be noted that these are merely used for convenience of description. Additionally, although the processes in respective steps may be described using an expression common to human activities, the processes described in the present specification is executed, in principle, by a variety of devices. Furthermore, other arrangements required to execute respective steps are self-evident from the aforementioned description.

What is claimed is:

1. A gaming machine with which a second wager for an insurance pay can be placed, comprising: a display for displaying an image relating to a unit game, in which it is determined whether or not a payout is awarded; an input switch for placing the second wager for the insurance pay; a counter for accumulating a count-value with successive execution of the unit games after the second wager is placed, and resetting the count-value when a predefined reset condition is met; and a controller operable to: (a) receive a first wager for the unit game; (b) provide a predefined payout to a player when an outcome of the unit game turns out to be a specific outcome; (c) receive the second wager for the insurance pay via the input switch; (d) execute transition into a second game, when the count-value reaches a predefined value in the unit game with the second wager for the insurance pay; and (e) provide the insurance pay according to an outcome of the second game, wherein the second game comprises a plurality of selectable elements displayed on the display and an amount of the insurance pay determined at least in part by a selection of one of the selectable elements via an input received by the controller, and wherein the plurality of selectable elements correspond to associated amounts of the insurance pay, respectively, wherein one of the associated amounts is greater than the second wager for the insurance pay, and another of the associated amounts is less than the second wager for the insurance pay.

2. The gaming machine according to claim 1, wherein the count-value is any one of the number of executed unit games, a bet amount on the unit game, and a difference between a bet amount and a payout amount in the unit game.

3. The gaming machine according to claim 1, wherein the predefined reset condition is that the transition into the second game is executed.

4. A gaming machine with which a second wager for an insurance pay can be placed, comprising: a display for displaying an image relating to a unit game, in which it is determined whether or not a payout is awarded; an input switch for placing the second wager for the insurance pay; a counter for accumulating a count-value with successive execution of the unit games after the second wager is placed, and resetting the count-value when a predefined reset condition is met; and a controller operable to: (a) receive a first wager for the unit game. (b) provide a predefined payout to a player when an outcome of the unit game turns out to be a specific outcome; (c) receive the second wager for the insurance pay via the input switch; (d) execute transition into a second game, when the count-value reaches a predefined value in the unit game with the second wager for the insurance pay; and (e) provide the insurance pay with coins or medals according to an outcome of the second game, wherein the second game comprises a plurality of selectable elements displayed on the display and an amount of the insurance pay determined at least in part by a selection of one of the selectable elements via an input received by the controller, and wherein the plurality of selectable elements correspond to associated amounts of the insurance pay, respectively, wherein one of the associated amounts is greater than the second wager for the insurance pay, and another of the associated amounts is less than the second wager for the insurance pay.

5. The gaming machine according to claim 4, wherein the count-value is any one of the number of executed unit games, a bet amount on the unit game, and a difference between a bet amount and a payout amount in the unit game.

6. The gaming machine according to claim 4, wherein the predefined reset condition is that the transition into the second game is executed.

7. A gaming machine with which a second wager for an insurance pay can be placed, comprising: a display for displaying an image relating to a unit game, in which it is determined whether or not a payout is awarded; an input switch for placing the second wager for the insurance pay; a counter for accumulating a count-value with successive execution of the unit games after the second wager is placed, and resetting the count-value when a predefined reset condition is met; and a controller operable to: (a) receive a first wager for the unit game. (b) provide a predefined payout to a player when an outcome of the unit game turns out to be a specific outcome; (c) receive the second wager for the insurance pay via the input switch; (d) execute transition into a second game, when the count-value reaches a predefined value in the unit game with the second wager for the insurance pay; and (e) provide the insurance pay according to an outcome of the second game, wherein the second game comprises a plurality of selectable elements displayed on the display and an amount of the insurance pay determined at least in part by a selection of one of the selectable elements via an input received by the controller, and wherein the plurality of selectable elements correspond to associated amounts of the insurance pay, respectively, wherein one of the associated amounts is equal to the second wager for the insurance pay, and another of the associated amounts is greater than the second wager for the insurance pay.

8. The gaming machine according to claim 7, wherein the count-value is any one of the number of executed unit games, a bet amount on the unit game, and a difference between a bet amount and a payout amount in the unit game.

9. The gaming machine according to claim 7, wherein the predefined reset condition is that the transition into the second game is executed.

10. A gaming machine with which a second wager for an insurance pay can be placed, comprising: a display for displaying an image relating to a unit game, in which it is determined whether or not a payout is awarded; an input switch for placing the second wager for the insurance pay; a counter for accumulating a count-value with successive execution of the unit games after the second wager is placed, and resetting the count-value when a predefined reset condition is met; and a controller operable to: (a) receive a first wager for the unit game. (b) provide a predefined payout to a player when an outcome of the unit game turns out to be a specific outcome; (c) receive the second wager for the insurance pay via the input switch; (d) execute transition into a second game, when the count-value reaches a predefined value in the unit game with the second wager for the insurance pay; and (e) provide the insurance pay with coins or medals according to an outcome of the second game, wherein the second game comprises a plurality of selectable elements displayed on the display, and an amount of the insurance pay is determined at least in part by a selection of one of the selectable elements via an input received by the controller, and wherein the plurality of selectable elements correspond to associated amounts of the insurance pay, respectively, wherein one of the associated amounts is equal to the second wager for the insurance pay, and another of the associated amounts is greater than the second wager for the insurance pay.

11. The gaming machine according to claim 10, wherein the count-value is any one of the number of executed unit games, a bet amount on the unit game, and a difference between a bet amount and a payout amount in the unit game.

12. The gaming machine according to claim 10, wherein the predefined reset condition is that the transition into the second game is executed.

13. A gaming machine with which a second wager for an insurance pay can be placed, the gaming machine comprising: a display for displaying an image relating to a unit game, in which it is determined whether or not a payout is awarded; an input switch for placing the second wager for the insurance pay; a counter for accumulating a count-value with successive execution of the unit games after the second wager is placed, and resetting the count-value when a predefined reset condition is met; and a controller operable to: (a) receive a first wager for the unit game. (b) provide a predefined payout to a player when an outcome of the unit game turns out to be a specific outcome; (c) receive the second wager for the insurance pay via the input switch; (d) execute transition into a second game, when the count-value reaches a predefined value in the unit game with the second wager for the insurance pay; and (e) provide the insurance pay according to an outcome of the second game, wherein the second game is a game in which three alternatives are displayed and an amount of the insurance pay is determined by selecting one of the alternatives with an input for selection by the player, and wherein the three alternatives correspond to the amounts of the insurance pay, respectively, a first of the amounts of the insurance pay is greater than the second wager for the insurance pay, a second of the amounts of the insurance pay is smaller than the second wager for the insurance pay, and a third of the amounts of the insurance pay is substantially equal to the second wager for the insurance pay.

14. A gaming machine with which a second wager for an insurance pay can be placed, the gaming machine comprising: a display for displaying an image relating to a unit game, in which it is determined whether or not a payout is awarded; an input switch for placing the second wager for the insurance pay; a counter for accumulating a count-value with successive execution of the unit games after the second wager is placed, and resetting the count-value when a predefined reset condition is met; and a controller operable to: (a) receive a first wager for the unit game. (b) provide a predefined payout to a player when an outcome of the unit game turns out to be a specific outcome; (c) receive the second wager for the insurance pay via the input switch and have the display an explanatory image of the insurance pay; (d) execute transition into a second game, when the count-value reaches a predefined value in the unit game with the second wager for the insurance pay; and (e) provide the insurance pay according to an outcome of the second game, wherein the second game is a game in which a plurality of alternatives are displayed and an amount of the insurance pay is determined by selecting one of the alternatives with an input for selection by the player, and wherein the plurality of alternatives correspond to the amounts of the insurance pay, respectively, one of the amounts of the insurance pay is greater than the second wager for the insurance pay, and another of the amounts of the insurance pay is smaller than the second wager for the insurance pay.

* * * * *